US012414630B2

(12) United States Patent
Doner

(10) Patent No.: US 12,414,630 B2
(45) Date of Patent: Sep. 16, 2025

(54) HANGING RIBBED CHAIR

(71) Applicant: Drew Steven Doner, Walsh, CO (US)

(72) Inventor: Drew Steven Doner, Walsh, CO (US)

( * ) Notice: Subject to any disclaimer, the term of this patent is extended or adjusted under 35 U.S.C. 154(b) by 454 days.

(21) Appl. No.: 17/993,801

(22) Filed: Nov. 23, 2022

(65) Prior Publication Data

US 2023/0165369 A1 Jun. 1, 2023

Related U.S. Application Data

(60) Provisional application No. 63/282,861, filed on Nov. 24, 2021.

(51) Int. Cl.
*A47C 3/025* (2006.01)

(52) U.S. Cl.
CPC ..... *A47C 3/0255* (2013.01)

(58) Field of Classification Search
CPC ..... A47C 3/0255
USPC ..... 297/277
See application file for complete search history.

(56) References Cited

U.S. PATENT DOCUMENTS

| | | | | |
|---|---|---|---|---|
| 719,301 | A * | 1/1903 | Campbell | 297/423.1 |
| 6,585,319 | B2 * | 7/2003 | Tseng | A47C 3/0255 297/277 |
| 9,468,284 | B2 * | 10/2016 | Wehner | A47C 4/18 |
| 10,912,386 | B2 * | 2/2021 | Xuemin | A47C 3/0255 |
| 11,369,201 | B2 * | 6/2022 | Yu | A47C 3/0255 |

* cited by examiner

*Primary Examiner* — Anthony D Barfield

(57) ABSTRACT

A hanging chair may comprise a front frame and a plurality of support members. The front frame may define a front opening. The plurality of support members may be coupled tro the front frame and may extend from a top portion of the front frame to a bottom portion of the front frame. The plurality of support members may extend axially rearward the front frame. The hanging chair may comprise a first side opening defined between the front frame and a first outer support member of the plurality of support members. The hanging chair may comprise a second side opening defined between the front frame and a second outer support member of the plurality of support members. The first side opening, the second side opening, and the front opening may be in fluid communication.

20 Claims, 9 Drawing Sheets

HANGING RIBBED CHAIR

CROSS REFERENCE TO RELATED APPLICATIONS

This application is a nonprovisional filing of, and claims priority to and the benefit of, U.S. Provisional Patent Application No. 63/282,861, filed Nov. 24, 2021, and entitled "HANGING RIBBED CHAIR," which is hereby incorporated by reference in its entirety.

FIELD

The present disclosure relates to chairs, and more specifically, to chairs configured to suspend in the air by hanging from an external support structure.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

DETAILED DESCRIPTION

The detailed description of exemplary embodiments herein makes reference to the accompanying drawings, which show exemplary embodiments by way of illustration. While these embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation.

The scope of the disclosure is defined by the appended claims and their legal equivalents rather than by merely the examples described. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, coupled, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts but not necessarily to denote the same or different materials.

Figure 1A:
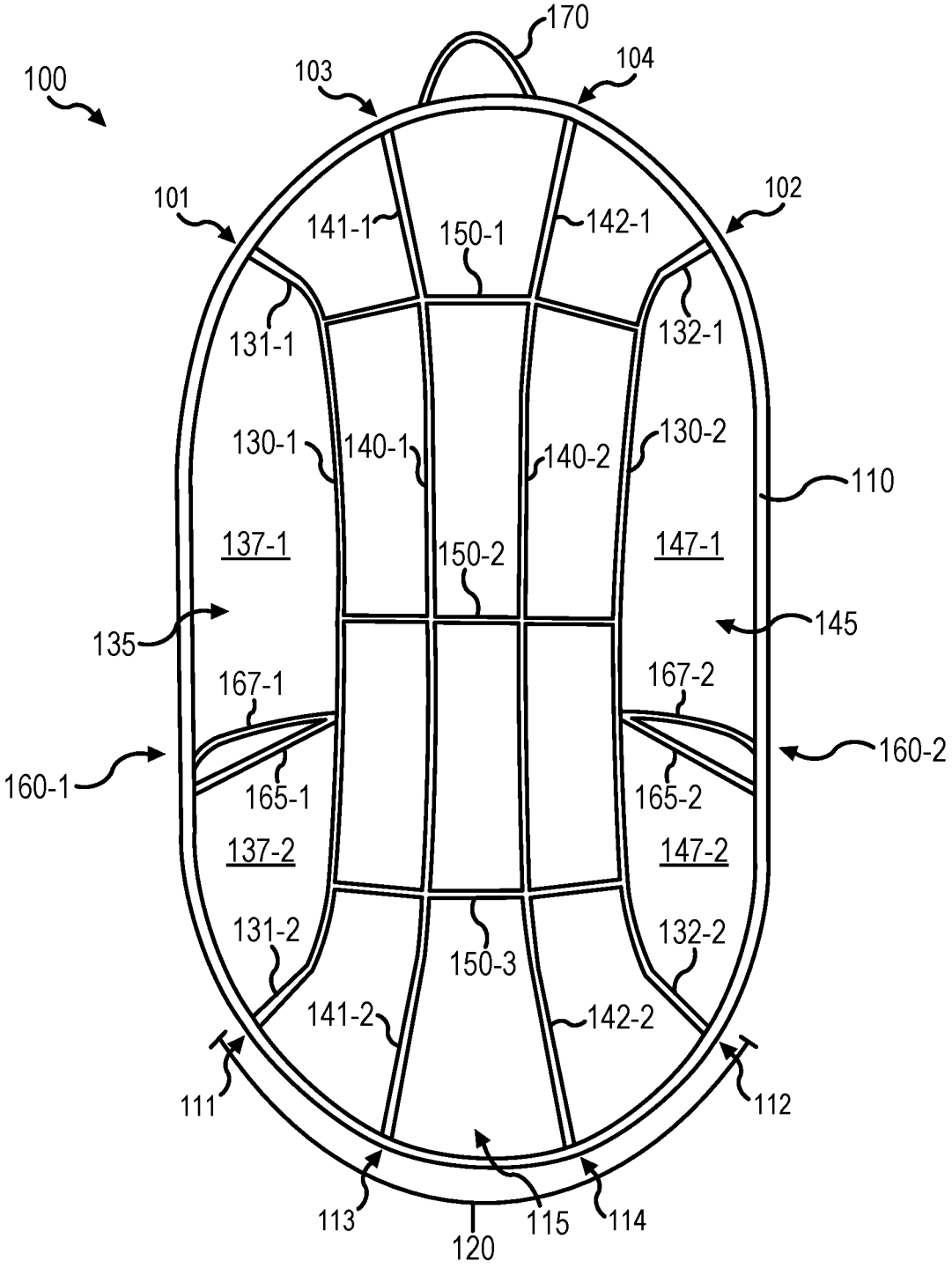
FIG. 1A illustrates a front perspective view of a chair, in accordance with various embodiments.
Figure 1B:
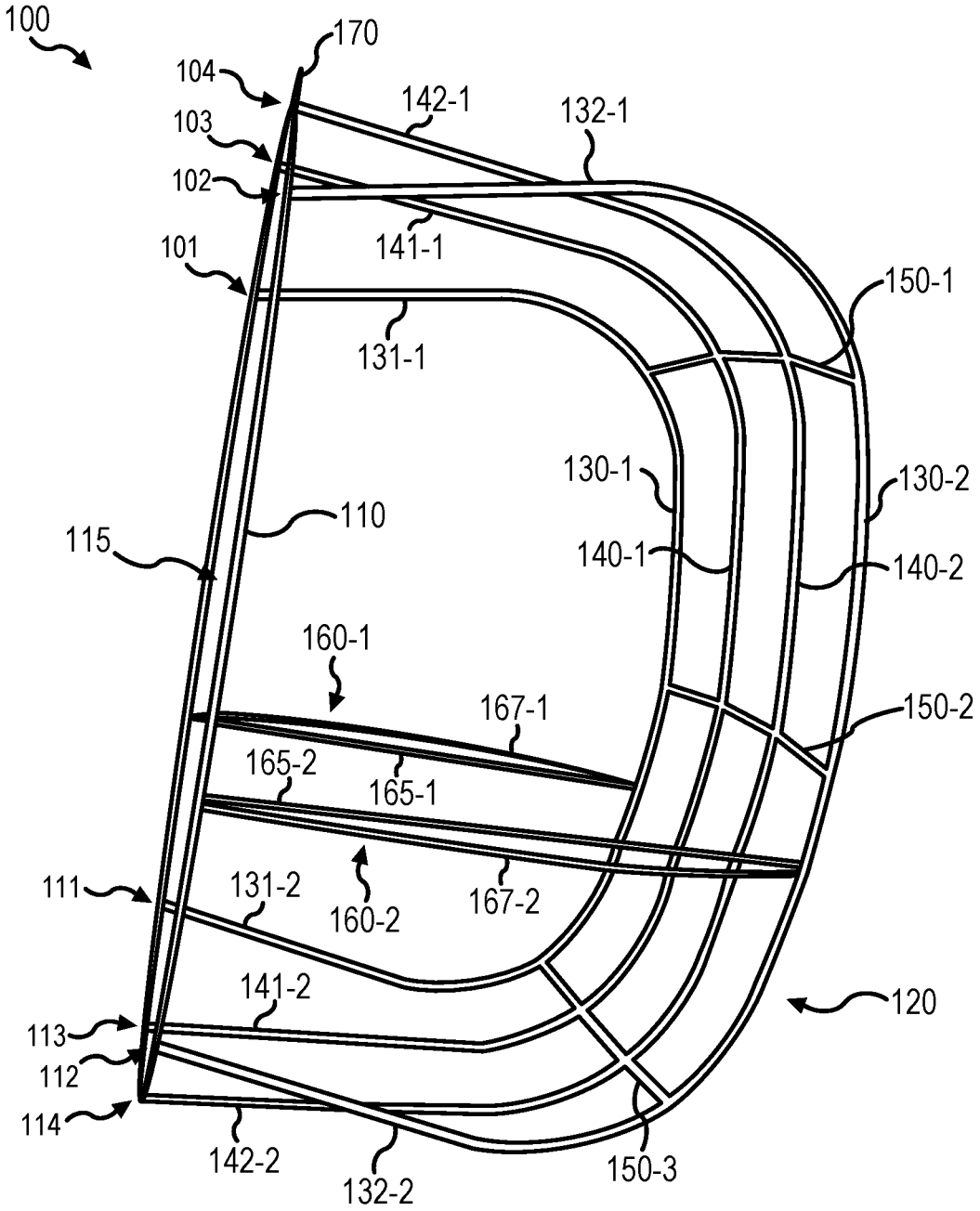
FIG. 1B illustrates a side perspective view of a chair, in accordance with various embodiments.
Figure 1C:
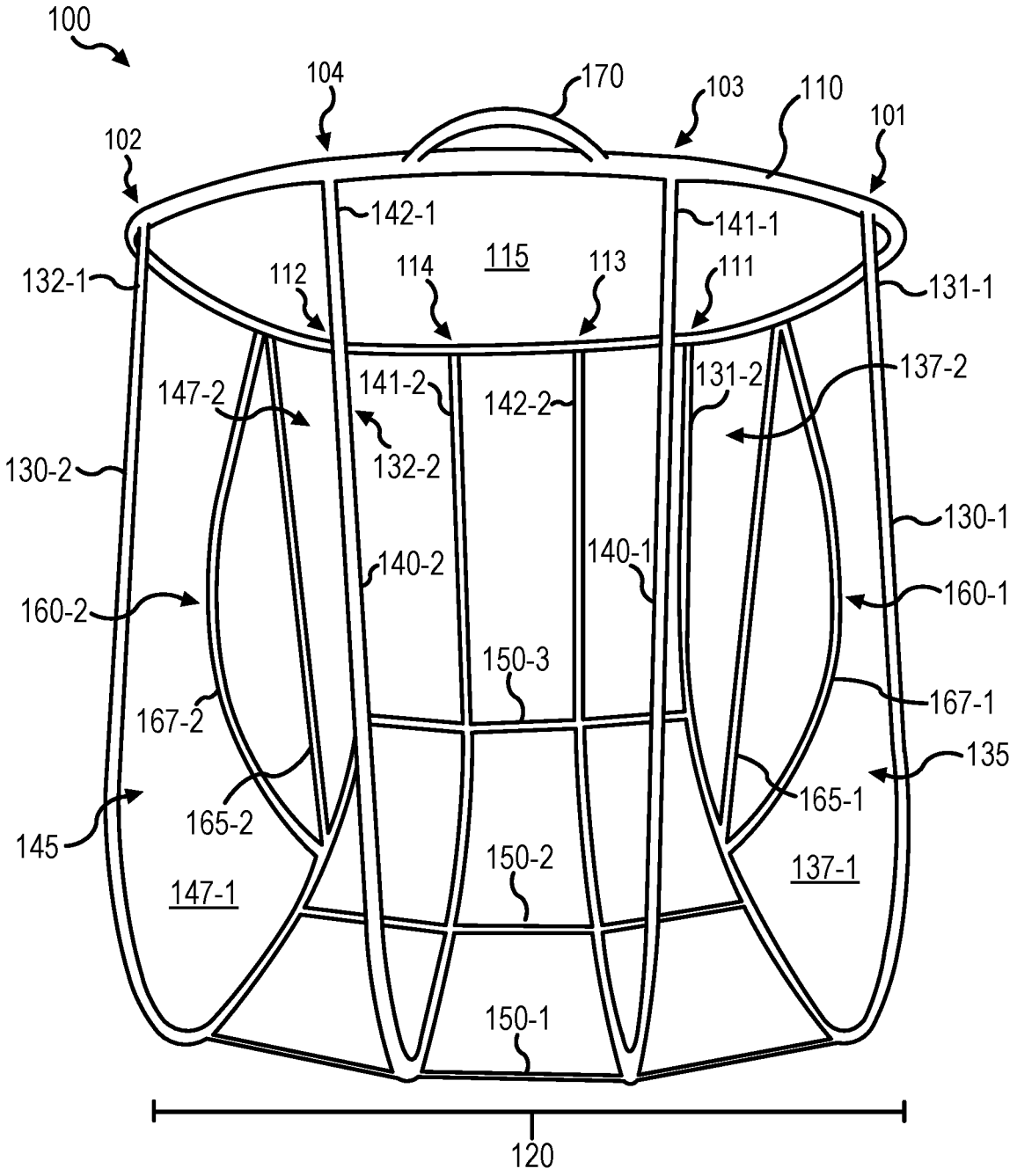
FIG. 1C illustrates a top perspective view of a chair, in accordance with various embodiments.

In various embodiments, and with reference to FIGS. 1A-1C, a chair 100 is disclosed. Chair 100 (e.g., a hanging chair, a suspension chair, a ribbed hanging chair, etc.) may be configured to couple to an overhead, external support structure to suspend in the air (e.g., to hang from the support structure above a surface of the ground). For example, chair 100 may be configured to couple to and suspend from a frame, a tree, a ceiling, a building beam, and/or any other external structure capable of providing support for chair 100.

In various embodiments, chair 100 may be sized, shaped, and configured to decrease weight in chair 100 compared to other chairs configured for suspension. For example, in some embodiments chair 100 may weigh less than 30 lbs. (13.6 kg). In some embodiments, chair 100 may decrease weight by decreasing relative supporting components compared (e.g., structure, design, building materials, etc.) to a typical chair configured for suspension.

Figure 6:
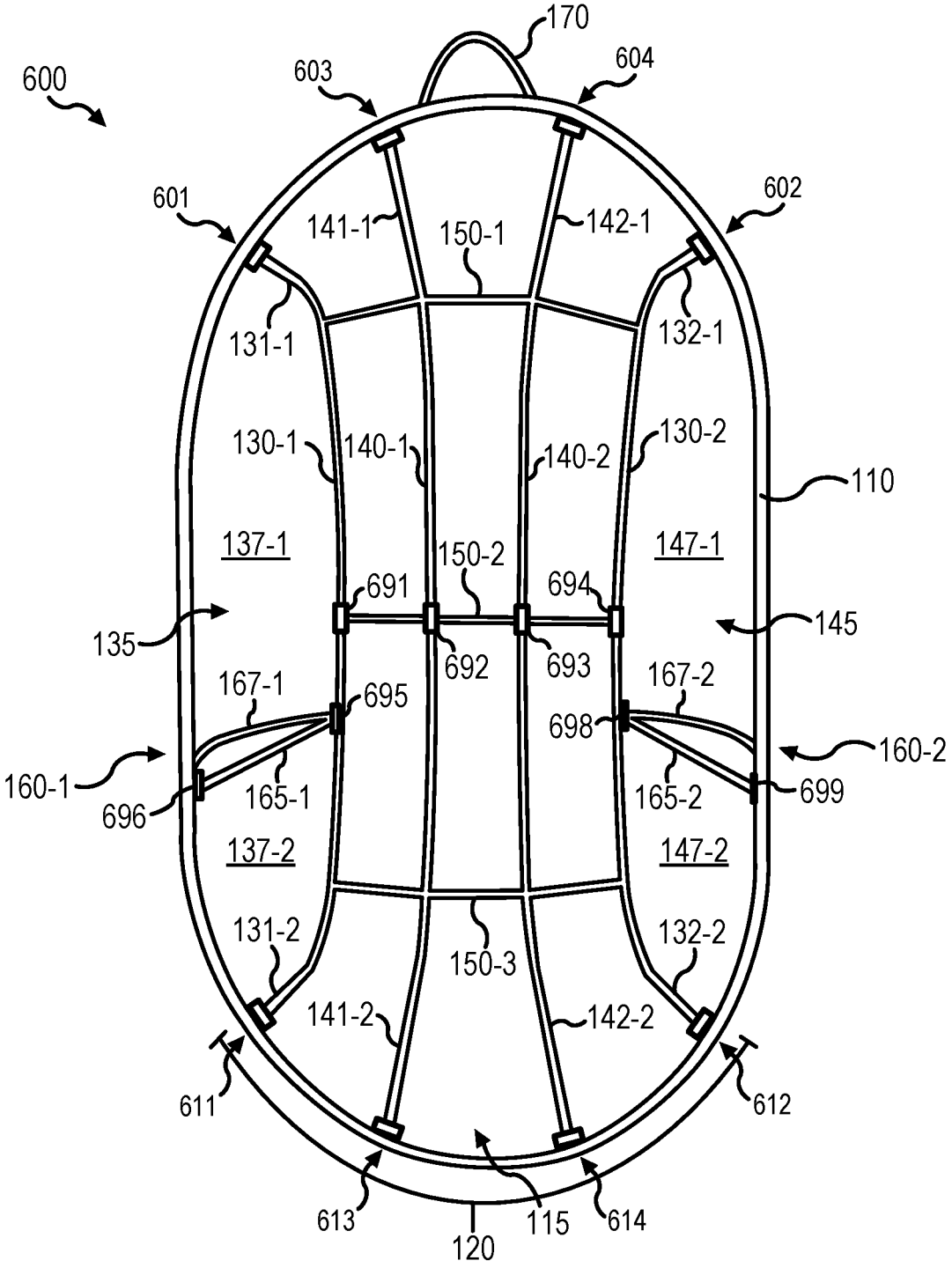
FIG. 6 illustrates a front perspective view of a chair with removable couplings, in accordance with various embodiments.

In various embodiments, chair 100 may be sized, shaped, and configured for assembly and disassembly during travel and shipping (e.g., as discussed further with reference to FIG. 6). In that regard, chair 100 may safely assemble and disassembly while also remaining sturdy and safe for use during occupancy (e.g., while a user sits in chair 100).

In various embodiments, chair 100 may be sized, shaped, and configured to optimize user comfort during use of chair 100. Chair 100 may be configured to optimize reclining and body position in response to a user sitting in chair 100. For example, chair 100 may be configured to transition from a rest position to a load position in response to a user sitting in chair 100 (e.g., as discussed further with reference to FIGS. 2A and 2B). In the load position, and in some embodiments, chair 100 may be positioned to increase user comfort relative to the rest position.

In various embodiments, chair 100 may comprise a front and a back. The front may be defined by a front frame 110. The back may be defined by a plurality of support members 120. The front may be axially forward the back. The front and the back may define an interior of chair 100. The interior of chair 100 may be sized and shaped to receive a user of chair 100 (e.g., to enable a user to enter and exit chair 100, sit within chair 100, etc.). The interior of chair 100 may be defined between front frame 110 and a forward surface of one or more support members 120. Chair 100 may comprise a first side and a second side defined between the front and the back. The first side (e.g., a right side) may be defined by a first armrest 160-1. The second side (e.g., a left side) may be defined by a second armrest 160-2.

In various embodiments, front frame 110 may define a front opening 115. Front frame 110 may circumferentially define front opening 115. Front opening 115 may enable a user of chair 100 to enter and exit chair 100 (e.g., to sit within chair 100). In that regard, front opening 115 may be in fluid communication with an interior of chair 100. Front frame 110 may be sized and shaped to allow the user of chair 100 to enter and exit chair 100 via front opening 115. Front frame 110 may comprise any suitable or desired shape. For example, front frame 110 may comprise a circular shape, a rectangular shape, a square shape, and/or the like. Front frame 110 may comprise an oval shape. Front frame 110 may comprise a pill shape. Front frame 110 may comprise a shape wherein a vertical length (e.g., a longitudinal length) of front frame 110 is greater than a horizontal length (e.g., a latitudinal length) of front frame 110 (wherein the "vertical length" refers to the longest vertical length of front frame 110 and the "horizontal length" refers to the longest horizontal length of front frame 110). Front frame 110 may comprise a symmetrical shape wherein a top half of front frame 110 is substantially the same as a bottom half of frame 110 (e.g., a top half of front frame 110 mirrors a bottom half of frame 110).

In various embodiments, front frame 110 may comprise any suitable and/or desired material. For example, front frame 110 may comprise a rigid material. Front frame 110 may comprise a wood material. Front frame 110 may comprise a metal material, such as stainless steel, steel, aluminum, and/or the like. In some embodiments, front frame 110 may comprise a reinforced steel material (e.g., rebar). In some embodiments, front frame 110 may comprise an about ½-inch (1.27 cm) steel rebar (wherein "about" as used in this sentence refers only to +/−0.01 inches (0.0254 cm)).

In various embodiments, support members 120 may comprise one or more inner support members and one or more out support members. For example, support members 120 may each comprise a first outer support member 130-1 (e.g., a right outer support member) and a second outer support member 130-2 (e.g., a left outer support member). First outer support member 130-1 may comprise a top end 131-1 (e.g., a first outer support member top end, a right outer support member top end, etc.) opposite a bottom end 131-2 (e.g., a first outer support member bottom end, a right outer support member bottom end, etc.). First outer support member 130-1 may comprise a body (e.g., a first outer support member body) defined between top end 131-1 and bottom end 131-2. Top end 131-1 and/or bottom end 131-2 may be axially forward the body. Top end 131-1 and/or bottom end 131-2 may be radially outward the body. Second outer support member 130-2 may comprise a top end 132-1 (e.g., a second outer support member top end, a left outer support member top end, etc.) opposite a bottom end 132-2 (e.g., a second outer support member bottom end, a left outer support member bottom end, etc.). Second outer support member 130-2 may comprise a body (e.g., a second outer support member body) defined between top end 132-1 and bottom end 132-2. Top end 132-1 and/or bottom end 132-2 may be axially forward the body. Top end 132-1 and/or bottom end 132-2 may be radially outward the body.

As a further example, support members 120 may comprise a first inner support member 140-1 (e.g., a left inner support member) and a second inner support member 140-2 (e.g., a right inner support member). First inner support member 140-1 may comprise a top end 141-1 (e.g., a first inner support member top end, a right inner support member top end, etc.) opposite a bottom end 141-2 (e.g., a first inner support member bottom end, a right inner support member bottom end, etc.). First inner support member 140-1 may comprise a body (e.g., a first inner support member body) defined between top end 141-1 and bottom end 141-2. Top end 141-1 and/or bottom end 141-2 may be axially forward the body. Top end 141-1 and/or bottom end 141-2 may be radially outward the body. Second inner support member 140-2 may comprise a top end 142-1 (e.g., a second inner support member top end, a left inner support member top end, etc.) opposite a bottom end 142-2 (e.g., a second inner support member bottom end, a left inner support member bottom end, etc.). Second inner support member 140-2 may comprise a body (e.g., a second inner support member body) defined between top end 142-1 and bottom end 142-2. Top end 142-1 and/or bottom end 142-2 may be axially forward the body. Top end 142-1 and/or bottom end 142-2 may be radially outward the body.

Each support member 120 may be coupled to front frame 110. For example, top end 131-1, top end 141-1, top end 142-1, and top end 132-1 may each be coupled to front frame 110 on a top half of frame 110. Bottom end 131-2, bottom end 141-2, bottom end 142-2, and bottom end 132-2 may each be coupled to frame 110 on a bottom half of frame 110. In that respect, the top end of each support member 120 may be coupled to frame 110 opposite the coupling of the bottom end of each support member 120 to frame 110.

In various embodiments, top end 131-1 of first outer support member 130-1 may be coupled to front frame 110 at a first top coupling point 101 (e.g., a first coupling point). Top end 132-1 of second outer support member 130-2 may be coupled to front frame 110 at a second top coupling point 102 (e.g., a second coupling point). Top end 141-1 of first inner support member 140-1 may be coupled to front frame 110 at a third top coupling point 103 (e.g., a third coupling point). Top end 142-1 of second inner support member 140-2 may be coupled to front frame 110 at a fourth top coupling point 104 (e.g., a fourth coupling point).

First top coupling point 101, second top coupling point 102, third top coupling point 103, and fourth top coupling point 104 may each be located on a top half of front frame 110. First top coupling point 101, second top coupling point 102, third top coupling point 103, and fourth top coupling point 104 may each comprise separate coupling locations on front frame 110. For example, each of first top coupling point 101, second top coupling point 102, third top coupling point 103, and fourth top coupling point 104 may be circumferentially separated on front frame 110.

First top coupling point 101 may be circumferentially outward from third top coupling point 103. First top coupling point 101 may be radially inward from third top coupling point 103 and/or fourth top coupling point 104. First top coupling point 101 may be colinear with second top coupling point 102.

Second top coupling point 102 may be circumferentially outward from fourth top coupling point 104. Second top coupling point 102 may be radially inward from third top coupling point 103 and/or fourth top coupling point 104. Second top coupling point 102 may be colinear with first top coupling point 101.

Third top coupling point 103 may be circumferentially inward from first top coupling point 101. Third top coupling point 103 may be radially outward from first top coupling point 101 and/or second top coupling point 102. Third top coupling point 103 may be colinear with fourth top coupling point 104.

Fourth top coupling point 104 may be circumferentially inward from second top coupling point 102. Fourth top coupling point 104 may be radially outward from first top coupling point 101 and/or second top coupling point 102. Fourth top coupling point 104 may be colinear with third top coupling point 103.

Third top coupling point 103 and fourth top coupling point 104 may be located between first top coupling point 101 and second top coupling point 102. First top coupling point 101 may be circumferentially separated from second top coupling point 102 by third top coupling point 103 and fourth top coupling point 104.

In various embodiments, bottom end 131-2 of first outer support member 130-1 may be coupled to front frame 110 at a first bottom coupling point 111 (e.g., a fifth coupling point). Bottom end 132-2 of second outer support member 130-2 may be coupled to front frame 110 at a second bottom coupling point 112 (e.g., a sixth coupling point). Bottom end 141-2 of first inner support member 140-1 may be coupled to front frame 110 at a third bottom coupling point 113 (e.g., a seventh coupling point). Bottom end 142-2 of second inner support member 140-2 may be coupled to front frame 110 at a fourth bottom coupling point 114 (e.g., an eighth coupling point).

First bottom coupling point 111, second bottom coupling point 112, third bottom coupling point 113, and fourth bottom coupling point 114 may each be located on a top bottom of front frame 110. First bottom coupling point 111, second bottom coupling point 112, third bottom coupling point 113, and fourth bottom coupling point 114 may each comprise separate coupling locations on front frame 110. For example, each of first bottom coupling point 111, second bottom coupling point 112, third bottom coupling point 113, and fourth bottom coupling point 114 may be circumferentially separated on front frame 110.

First bottom coupling point 111 may be circumferentially outward from third bottom coupling point 113. First bottom coupling point 111 may be radially inward from third bottom coupling point 113 and/or fourth bottom coupling point 114. First bottom coupling point 111 may be colinear with second bottom coupling point 112. First bottom coupling point 111 may be colinear with first top coupling point 101.

Second bottom coupling point 112 may be circumferentially outward from fourth bottom coupling point 114. Second bottom coupling point 112 may be radially inward from third bottom coupling point 113 and/or fourth bottom coupling point 114. Second bottom coupling point 112 may be colinear with first bottom coupling point 111. Second bottom coupling point 112 may be colinear with second top coupling point 102.

Third bottom coupling point 113 may be circumferentially inward from first bottom coupling point 111. Third bottom coupling point 113 may be radially outward from first bottom coupling point 111 and/or second bottom coupling point 112. Third bottom coupling point 113 may be colinear with fourth bottom coupling point 114. Third bottom coupling point 113 may be colinear with third top coupling point 103.

Fourth bottom coupling point 114 may be circumferentially inward from second bottom coupling point 112. Fourth bottom coupling point 114 may be radially outward from first bottom coupling point 111 and/or second bottom coupling point 112. Fourth bottom coupling point 114 may be colinear with third bottom coupling point 113. Fourth bottom coupling point 114 may be colinear with fourth top coupling point 104.

Third bottom coupling point 113 and fourth bottom coupling point 114 may be located between first bottom coupling point 111 and second bottom coupling point 112. First bottom coupling point 111 may be circumferentially separated from second bottom coupling point 112 by third bottom coupling point 113 and fourth bottom coupling point 114.

In various embodiments, first top coupling point 101 may be coplanar with first bottom coupling point 111. In various embodiments, second top coupling point 102 may be coplanar with second bottom coupling point 112. In various embodiments, third top coupling point 103 may be coplanar with third bottom coupling point 113. In various embodiments, fourth top coupling point 104 may be coplanar with fourth bottom coupling point 114.

In various embodiments, each coupling (e.g., coupling point) between a support member 120 and front frame 110 may comprise any suitable or desired type of coupling. For example, one or more support members 120 may be fixably coupled or removably coupled to front frame 110. As a further example, one or more support members 120 may be coupled to front frame 110 via welding, an adhesive, and/or the like. As a further example, one or more support members 120 may be coupled to front frame 110 using a rope, a weave, a thread, and/or the like.

In various embodiments, each support member 120 may be vertically positioned (e.g., vertically displaced) within chair 100. One or more support members 120 may be positioned proximate a middle section of chair 100. Support members 120 may be configured to form a three-dimensional shape. Support members 120 may be configured to form a C-shape. Support members 120 may be configured to form a D-shape. Support members 120 may be configured to form a seat in chair 100. In that respect, support members 120 may form a first platform configured to support a user sitting in chair 100, a second platform configured to provide a back support for the user sitting in chair 100, and/or a third platform configured to provide a top surface (e.g., a roof, a shelter, a shade, etc.) in chair 100. The first platform may be substantially similar (e.g., in size, shape, surface area, volume, etc.) to the third platform. The second platform may comprise a surface area greater than the first platform and/or the third platform. The first platform and/or the third platform may be axially inward from the second platform (e.g., the second platform may be axially outward from the first platform and/or the third platform). The first platform and/or the third platform may be radially outward from the second platform (e.g., the second platform may be radially inward from the first platform and/or the third platform). The second platform may be at least partially surrounded by the first platform and/or the third platform. The second platform may be surrounded by the first platform, the third platform, first side opening 135, and/or second side opening 145.

Each support member 120 may comprise any suitable shape. For example, one or more support members 120 may comprise a curved shape, a bowed shape, and/or the like. In that respect, each end of the one or more support members 120 may be inward relative to a remaining body of each of the one or more support members 120. As a further example, one or more support members 120 may comprise a symmetrical shape. In various embodiments, one or more of support members 120 may comprise a different shape from one or more of the remaining support members 120.

In various embodiments, outer support members 130-1, 130-2 may each comprise a first shape and inner support members 140-1, 140-2 may each comprise a second shape. The first shape may be different from the second shape. In some embodiments, the first shape may comprise a first vertical length (e.g., a longitudinal length) and the second shape may comprise a second vertical length (wherein a "vertical length" refers to a length measurement from end to end of each respective support member). The first vertical length of the first shape may be different from the second vertical length of the second shape. The first vertical length of the first shape may be smaller than the second vertical length of the second shape (e.g., the second vertical length of the second shape may be bigger than the first vertical length of the first shape) (e.g., as depicted in FIG. 1A).

In various embodiments, first outer support member 130-1 may comprise a first shape, second outer support member 130-2 may comprise a second shape, first inner support members 140-1 may comprise a third shape, and second inner support members 140-2 may comprise a fourth shape. The first shape may be different from the third shape and/or the fourth shape. The first shape may be similar to the second shape. The first shape may be the same as the second shape. The second shape may be different from the third shape and/or the fourth shape. The third shape may be different from the first shape and/or the second shape. The third shape may be similar to the fourth shape. The third shape may be the same as the fourth shape. The fourth shape may be different from the first shape and/or the second shape.

In various embodiments, one or more ends of one or more support members 120 may be displaced (e.g., disposed, positioned, curved, bent, etc.) at an angle relative to a remaining body (e.g., a middle portion) of the respective support member 120. For example, first end 131-1 may be displaced at a first angle relative to a middle portion of first outer support member 130-1 and second end 131-2 may be displaced at a second angle relative to a middle portion of first outer support member 130-1. As a further example, first end 132-1 may be displaced at a third angle relative to a middle portion of second outer support member 130-2 and second end 132-2 may be displaced at a fourth angle relative to a middle portion of second outer support member 130-2. As a further example, first end 141-1 may be displaced at a fifth angle relative to a middle portion of first inner support member 140-1 and second end 141-2 may be displaced at a sixth angle relative to a middle portion of first inner support member 140-1. As a further example, first end 142-1 may be displaced at a seventh angle relative to a middle portion of second inner support member 140-2 and second end 142-2 may be displaced at an eighth angle relative to a middle portion of second inner support member 140-2.

In various embodiments, the first angle, the second angle, the third angle, the fourth angle, the fifth angle, the sixth angle, the seventh angle, and/or the eighth angle may each be greater than about 90°. The first angle, the second angle, the third angle, the fourth angle, the fifth angle, the sixth angle, the seventh angle, and/or the eighth angle may each be less than about 180°. The first angle, the second angle, the third angle, the fourth angle, the fifth angle, the sixth angle, the seventh angle, and/or the eighth angle may each be greater than about 90° and less than about 180° (wherein "about" as used in this paragraph refers only to +/−) 5°.

In various embodiments, one or more of the first angle, the second angle, the third angle, and/or the fourth angle may be different from one or more of the fifth angle, the sixth angle, the seventh angle, and/or the eighth angle. In that regard, the angles of outer support members 130-1, 130-2 may be different from the angles of inner support members 140-1, 140-2. In various embodiments, one or more of the first angle, the second angle, the third angle, and/or the fourth angle may be less than one or more of the fifth angle, the sixth angle, the seventh angle, and/or the eighth angle. In that regard, the angles of outer support members 130-1, 130-2 may be less than the angles of inner support members 140-1, 140-2.

In various embodiments, one or more of the fifth angle, the sixth angle, the seventh angle, and/or the eighth angle may be different from one or more of the first angle, the second angle, the third angle, and/or the fourth angle. In that regard, the angles of inner support members 140-1, 140-2 may be different from the angles of outer support members 130-1, 130-2. In various embodiments, one or more of the fifth angle, the sixth angle, the seventh angle, and/or the eighth angle may be greater than one or more of the first angle, the second angle, the third angle, and/or the fourth angle. In that regard, the angles of inner support members 140-1, 140-2 may be greater than the angles of outer support members 130-1, 130-2.

In various embodiments, the first angle and the second angle of first outer support member 130-1 may be about equal (e.g., the first angle is about equal to the second angle, etc.). The third angle and the fourth angle of second outer support member 130-2 may be about equal (e.g., the third angle is about equal to the fourth angle, etc.). The first angle of first outer support member 130-1 may be about equal to one or more of the second angle of first outer support member 130-1, the third angle of second outer support member 130-2, and/or the fourth angle of second outer support member 130-2 (e.g., the first angle is about equal to the second angle, the first angle is about equal to the third angle, the first angle is about equal to the fourth angle, etc.). The second angle of first outer support member 130-1 may be about equal to one or more of the first angle of first outer support member 130-1, the third angle of second outer support member 130-2, and/or the fourth angle of second outer support member 130-2 (e.g., the second angle is about equal to the first angle, the second angle is about equal to the third angle, the second angle is about equal to the fourth angle, etc.). The third angle of second outer support member 130-2 may be about equal to one or more of the first angle of first outer support member 130-1, second angle of first outer support member 130-1, and/or the fourth angle of second outer support member 130-2 (e.g., the third angle is about equal to the first angle, the third angle is about equal to the second angle, the third angle is about equal to the fourth angle, etc.). The fourth angle of second outer support member 130-2 may be about equal to one or more of the first angle of first outer support member 130-1, second angle of first outer support member 130-1, and/or the third angle of second outer support member 130-2 (e.g., the fourth angle is about equal to the first angle, the fourth angle is about equal to the second angle, the fourth angle is about equal to the third angle, etc.) (wherein "about" as used in this paragraph refers only to +/−) 5°.

In various embodiments, the fifth angle and the sixth angle of first inner support member 140-1 may be about equal (e.g., the fifth angle is about equal to the sixth angle, etc.). The seventh angle and the eighth angle of second inner support member 140-2 may be about equal (e.g., the seventh angle is about equal to the eighth angle, etc.). The fifth angle of first inner support member 140-1 may be about equal to one or more of the sixth angle of first inner support member 140-1, the seventh angle of second inner support member 140-2, and/or the eighth angle of second inner support member 140-2 (e.g., the fifth angle is about equal to the sixth angle, the fifth angle is about equal to the seventh angle, the fifth angle is about equal to the eighth angle, etc.). The sixth angle of first inner support member 140-1 may be about equal to one or more of the fifth angle of first inner support member 140-1, the seventh angle of second inner support member 140-2, and/or the eighth angle of second inner support member 140-2 (e.g., the sixth angle is about equal to the fifth angle, the sixth angle is about equal to the seventh angle, the sixth angle is about equal to the eighth angle, etc.).

The seventh angle of first inner support member 140-1 may be about equal to one or more of the fifth angle of first inner support member 140-1, the sixth angle of first inner support member 140-1, and/or the eighth angle of second inner support member 140-2 (e.g., the seventh angle is about equal to the fifth angle, the seventh angle is about equal to the sixth angle, the seventh angle is about equal to the eighth angle, etc.). The eighth angle of first inner support member 140-1 may be about equal to one or more of the fifth angle of first inner support member 140-1, the sixth angle of first inner support member 140-1, and/or the seventh angle of second inner support member 140-2 (e.g., the eighth angle is about equal to the fifth angle, the eighth angle is about equal to the sixth angle, the eighth angle is about equal to the seventh angle, etc.) (wherein "about" as used in this paragraph refers only to +/−) 5°.

In various embodiments, the first angle of first outer support member 130-1 may be different from one or more of the fifth angle of first inner support member 140-1, the sixth angle of first inner support member 140-1, the seventh angle of second inner support member 140-2, and/or the eighth angle of second inner support member 140-2. In various embodiments, the first angle of first outer support member 130-1 may be less than one or more of the fifth angle of first inner support member 140-1, the sixth angle of first inner support member 140-1, the seventh angle of second inner support member 140-2, and/or the eighth angle of second inner support member 140-2.

In various embodiments, the second angle of first outer support member 130-1 may be different from one or more of the fifth angle of first inner support member 140-1, the sixth angle of first inner support member 140-1, the seventh angle of second inner support member 140-2, and/or the eighth angle of second inner support member 140-2. In various embodiments, the second angle of first outer support member 130-1 may be less than one or more of the fifth angle of first inner support member 140-1, the sixth angle of first inner support member 140-1, the seventh angle of second inner support member 140-2, and/or the eighth angle of second inner support member 140-2.

In various embodiments, the third angle of second outer support member 130-2 may be different from one or more of the fifth angle of first inner support member 140-1, the sixth angle of first inner support member 140-1, the seventh angle of second inner support member 140-2, and/or the eighth angle of second inner support member 140-2. In various embodiments, the third angle of second outer support member 130-2 may be less than one or more of the fifth angle of first inner support member 140-1, the sixth angle of first inner support member 140-1, the seventh angle of second inner support member 140-2, and/or the eighth angle of second inner support member 140-2.

In various embodiments, the fourth angle of second outer support member 130-2 may be different from one or more of the fifth angle of first inner support member 140-1, the sixth angle of first inner support member 140-1, the seventh angle of second inner support member 140-2, and/or the eighth angle of second inner support member 140-2. In various embodiments, the fourth angle of second outer support member 130-2 may be less than one or more of the fifth angle of first inner support member 140-1, the sixth angle of first inner support member 140-1, the seventh angle of second inner support member 140-2, and/or the eighth angle of second inner support member 140-2.

In various embodiments, the fifth angle of first inner support member 140-1 may be different from one or more of the first angle of first outer support member 130-1, the second angle of first outer support member 130-1, the third angle of second outer support member 130-2, and/or the fourth angle of second outer support member 130-2. In various embodiments, the fifth angle of first inner support member 140-1 may be greater than one or more of the first angle of first outer support member 130-1, the second angle of first outer support member 130-1, the third angle of second outer support member 130-2, and/or the fourth angle of second outer support member 130-2.

In various embodiments, the sixth angle of first inner support member 140-1 may be different from one or more of the first angle of first outer support member 130-1, the second angle of first outer support member 130-1, the third angle of second outer support member 130-2, and/or the fourth angle of second outer support member 130-2. In various embodiments, the sixth angle of first inner support member 140-1 may be greater than one or more of the first angle of first outer support member 130-1, the second angle of first outer support member 130-1, the third angle of second outer support member 130-2, and/or the fourth angle of second outer support member 130-2.

In various embodiments, the seventh angle of second inner support member 140-2 may be different from one or more of the first angle of first outer support member 130-1, the second angle of first outer support member 130-1, the third angle of second outer support member 130-2, and/or the fourth angle of second outer support member 130-2. In various embodiments, the seventh angle of second inner support member 140-2 may be greater than one or more of the first angle of first outer support member 130-1, the second angle of first outer support member 130-1, the third angle of second outer support member 130-2, and/or the fourth angle of second outer support member 130-2.

In various embodiments, the eighth angle of second inner support member 140-2 may be different from one or more of the first angle of first outer support member 130-1, the second angle of first outer support member 130-1, the third angle of second outer support member 130-2, and/or the fourth angle of second outer support member 130-2. In various embodiments, the eighth angle of second inner support member 140-2 may be greater than one or more of the first angle of first outer support member 130-1, the second angle of first outer support member 130-1, the third angle of second outer support member 130-2, and/or the fourth angle of second outer support member 130-2.

In various embodiments, each support member 120 may comprise any suitable and/or desired material. For example, each support member 120 may comprise a rigid material. Each support member 120 may comprise a wood material. Each support member 120 may comprise a metal material, such as stainless steel, steel, aluminum, and/or the like. In some embodiments, each support member 120 may comprise a reinforced steel material (e.g., rebar). In some embodiments, each support member 120 may comprise an about 3/8-inch (0.9525 cm) steel rebar (wherein "about" as used in this sentence refers only to +/−0.01 inches (0.0254 cm)). In some embodiments, support members 120 may comprise a same material as front frame 110. In some embodiments, support members 120 may comprise a material having a diameter less than a diameter of a material of front frame 110 (e.g., front frame 110 may comprise a first material having a first diameter, support members 120 may comprise a second material having a second diameter, and the first diameter may be greater than the second diameter).

In various embodiments, a first distance may be defined between first outer support member 130-1 and second outer support member 130-2. The first distance may vary in the vertical direction (e.g., the first distance may vary radially in chair 100). For example, the first distance proximate the top ends of first outer support member 130-1 and second outer support member 130-2 may be different from the first distance proximate a middle portion of first outer support member 130-1 and second outer support member 130-2. The first distance proximate the top ends of first outer support member 130-1 and second outer support member 130-2 may be greater than the first distance proximate a middle portion of first outer support member 130-1 and second outer support member 130-2. As a further example, the first distance proximate the bottom ends of first outer support member 130-1 and second outer support member 130-2 may be different from the first distance proximate a middle portion of first outer support member 130-1 and second outer support member 130-2. The first distance proximate the bottom ends of first outer support member 130-1 and second outer support member 130-2 may be greater than the first distance proximate a middle portion of first outer support member 130-1 and second outer support member 130-2. As a further example, the first distance proximate the top ends of first outer support member 130-1 and second outer support member 130-2 may be substantially similar to the first distance proximate the bottom ends of first outer support member 130-1 and second outer support member 130-2.

In various embodiments, a second distance may be defined between first inner support member 140-1 and second inner support member 140-2. The second distance may vary in the vertical direction (e.g., the second distance may vary radially in chair 100). For example, the second distance proximate the top ends of first inner support member 140-1 and second inner support member 140-2 may be different from the second distance proximate a middle portion of first inner support member 140-1 and second inner support member 140-2. The second distance proximate the top ends of first inner support member 140)-1 and second inner support member 140-2 may be greater than the second distance proximate a middle portion of first inner support member 140-1 and second inner support member 140-2. As a further example, the second distance proximate the bottom ends of first inner support member 140-1 and second inner support member 140-2 may be different from the second distance proximate a middle portion of first inner support member 140-1 and second inner support member 140-2. The second distance proximate the bottom ends of first inner support member 140-1 and second inner support member 140-2 may be greater than the second distance proximate a middle portion of first inner support member 140-1 and second inner support member 140-2. As a further example, the second distance proximate the top ends of first inner support member 140-1 and second inner support member 140-2 may be substantially similar to the second distance proximate the bottom ends of first inner support member 140-1 and second inner support member 140-2.

In various embodiments, a third distance may be defined between first outer support member 130-1 and first inner support member 140-1. The third distance may vary in the vertical direction (e.g., the third distance may vary radially in chair 100). For example, the third distance proximate the top ends of first outer support member 130-1 and first inner support member 140-1 may be different from the third distance proximate a middle portion of first outer support member 130-1 and first inner support member 140-1. The third distance proximate the top ends of first outer support member 130-1 and first inner support member 140-1 may be greater than the third distance proximate a middle portion of first outer support member 130-1 and first inner support member 140-1. As a further example, the third distance proximate the bottom ends of first outer support member 130-1 and first inner support member 140-1 may be different from the third distance proximate a middle portion of first outer support member 130-1 and first inner support member 140-1. The third distance proximate the bottom ends of first outer support member 130-1 and first inner support member 140-1 may be greater than the third distance proximate a middle portion of first outer support member 130-1 and first inner support member 140-1. As a further example, the third distance proximate the top ends of first outer support member 130-1 and first inner support member 140-1 may be substantially similar to the third distance proximate the bottom ends of first outer support member 130-1 and first inner support member 140-1.

In various embodiments, a fourth distance may be defined between second inner support member 140-2 and second outer support member 130-2. The fourth distance may vary in the vertical direction (e.g., the fourth distance may vary radially in chair 100). For example, the fourth distance proximate the top ends of second inner support member 140-2 and second outer support member 130-2 may be different from the fourth distance proximate a middle portion of second inner support member 140-2 and second outer support member 130-2. The fourth distance proximate the top ends of second inner support member 140-2 and second outer support member 130-2 may be greater than the fourth distance proximate a middle portion of second inner support member 140-2 and second outer support member 130-2. As a further example, the fourth distance proximate the bottom ends of second inner support member 140-2 and second outer support member 130)-2 may be different from the fourth distance proximate a middle portion of second inner support member 140-2 and second outer support member 130-2. The fourth distance proximate the bottom ends of second inner support member 140-2 and second outer support member 130-2 may be greater than the fourth distance proximate a middle portion of second inner support member 140-2 and second outer support member 130-2. As a further example, the fourth distance proximate the top ends of second inner support member 140)-2 and second outer support member 130-2 may be substantially similar to the fourth distance proximate the bottom ends of second inner support member 140-2 and second outer support member 130-2.

In various embodiments, chair 100 may comprise one or more cross members 150. Each cross member 150 may be coupled to one or more support members 120. Cross members 150 may be configured to provide structural support and/or reinforcement to chair 100. Cross members 150 may be horizontally positioned in chair 100. Cross members 150) may be positioned perpendicular to one or more support members 120. One or more cross members 150 may be parallel to one or more other cross members 150).

In various embodiments, chair 100 may comprise any suitable number of cross members 150. For example, chair 100 may comprise a first cross member 150-1, a second cross member 150)-2, and/or a third cross member 150-3. First cross member 150-1 may be positioned proximate a top end of one or more support members 120. Second cross member 150-2 may be positioned proximate a middle portion of one or more support members 120. Third cross member 150-3 may be positioned proximate a bottom end of one or more support members 120. First cross member 150-1 may be positioned radially upward (e.g., outward) from second cross member 150-2 and/or third cross member 150-3. Second cross member 150-2 may be positioned between first cross member 150-1 and third cross member 150-3. Third cross member 150-3 may be radially downward (e.g., outward) from second cross member 150-2 and/or first cross member 150-1. In some embodiments, first cross member 150-1 may be symmetrical with third cross member 150-3.

In various embodiments, first cross member 150-1 may be coupled to one or more of first outer support member 130-1, first inner support member 140-1, second inner support member 140-2, and/or second outer support member 130-2. For example, first cross member 150-1 may be coupled to first outer support member 130-1 at a location radially inward from first end 131-1 of first outer support member 130-1. First cross member 150)-1 may be coupled to first inner support member 140-1 at a location radially inward from first end 141-1 of first inner support member 140-1. First cross member 150-1 may be coupled to second inner support member 140-2 at a location radially inward from first end 142-1 of second inner support member 140-2. First cross member 150-1 may be coupled to second outer support member 130-2 at a location radially inward from first end 132-1 of second outer support member 130-2.

In some embodiments, first cross member 150-1 may comprise a single component (e.g., a unitary component. In that respect, the single component of first cross member 150)-1 may extend between and couple to each of first outer support member 130-1, first inner support member 140-1, second inner support member 140-2, and/or second outer support member 130-2. In some embodiments, first cross member 150-1 may comprise a plurality of components. For example, first cross member 150-1 may comprise a first part, a second part, and/or a third part. Each part may comprise separate objects. The first part may extend between and couple to first outer support member 130-1 and first inner support member 140-1. The second part may extend between and couple to first inner support member 140-1 and second inner support member 140-2. The third part may extend between and couple to second inner support member 140-2 and second outer support member 130-2.

In various embodiments, second cross member 150-2 may be coupled to one or more of first outer support member 130-1, first inner support member 140-1, second inner support member 140-2, and/or second outer support member 130-2. For example, second cross member 150-2 may be coupled to first outer support member 130-1 at a location proximate a middle portion of first outer support member 130-1. Second cross member 150-2 may be coupled to first inner support member 140-1 at a location proximate a middle portion of first inner support member 140-1. Second cross member 150-2 may be coupled to second inner support member 140-2 at a location proximate a middle portion of second inner support member 140-2. Second cross member 150-2 may be coupled to second outer support member 130-2 at a location proximate a middle portion of second outer support member 130-2.

In some embodiments, second cross member 150-2 may comprise a single component (e.g., a unitary component. In that respect, the single component of second cross member 150-2 may extend between and couple to each of first outer support member 130-1, first inner support member 140-1, second inner support member 140-2, and/or second outer support member 130-2. In some embodiments, second cross member 150-2 may comprise a plurality of components. For example, second cross member 150-2 may comprise a first part, a second part, and/or a third part. Each part may comprise separate objects. The first part may extend between and couple to first outer support member 130-1 and first inner support member 140-1. The second part may extend between and couple to first inner support member 140-1 and second inner support member 140-2. The third part may extend between and couple to second inner support member 140-2 and second outer support member 130-2.

In various embodiments, third cross member 150-3 may be coupled to one or more of first outer support member 130-1, first inner support member 140-1, second inner support member 140-2, and/or second outer support member 130-2. For example, third cross member 150-3 may be coupled to first outer support member 130-1 at a location radially inward from second end 131-1 of first outer support member 130-1. Third cross member 150)-3 may be coupled to first inner support member 140-1 at a location radially inward from second end 141-2 of first inner support member 140-1. Third cross member 150-3 may be coupled to second inner support member 140-2 at a location radially inward from second end 142-2 of second inner support member 140-2. Third cross member 150-3 may be coupled to second outer support member 130-2 at a location radially inward from second end 132-2 of second outer support member 130-2.

In some embodiments, third cross member 150-3 may comprise a single component (e.g., a unitary component. In that respect, the single component of third cross member 150-3 may extend between and couple to each of first outer support member 130-1, first inner support member 140-1, second inner support member 140-2, and/or second outer support member 130-2. In some embodiments, third cross member 150-3 may comprise a plurality of components. For example, third cross member 150-3 may comprise a first part, a second part, and/or a third part. Each part may comprise separate objects. The first part may extend between and couple to first outer support member 130-1 and first inner support member 140-1. The second part may extend between and couple to first inner support member 140-1 and second inner support member 140-2. The third part may extend between and couple to second inner support member 140-2 and second outer support member 130-2.

In various embodiments, each coupling (e.g., coupling point) between a cross member 150 and a support member 120 may comprise any suitable or desired type of coupling. For example, one or more cross members 150 may be fixably coupled or removably coupled to a respective support member 120. As a further example, one or more cross members 150 may be coupled to a respective support member 120 via welding, an adhesive, and/or the like. As a further example, one or more cross members 150 may be coupled to a respective support member 120 using a rope, a weave, a thread, and/or the like.

In various embodiments, each cross member 150 may comprise any suitable and/or desired material. For example, each cross member 150 may comprise a rigid material. Each cross member 150 may comprise a wood material. Each cross member 150 may comprise a metal material, such as stainless steel, steel, aluminum, and/or the like. In some embodiments, one or more cross member 150 may comprise a ¼-inch (0.635 cm) smooth rolled steel rod. In some embodiments, one or more cross member 150 may comprise a reinforced steel material (e.g., rebar). In some embodiments, one or more cross members 150 may comprise an about ⅜-inch (0.9525 cm) steel rebar. In some embodiments, cross members 150 may comprise a same material as front frame 110 and/or support members 120. In some embodiments, cross members 150 may comprise a material having a diameter less than a diameter of a material of front frame 110 (e.g., front frame 110 may comprise a first material having a first diameter, cross members 150 may comprise a third material having a third diameter, and the first diameter may be greater than the third diameter). In some embodiments, cross members 150 may comprise a material having a diameter about equal to a diameter of a material of support members 120 (e.g., support members 120 may comprise a second material having a second diameter, cross members 150 may comprise a third material having a third diameter, and the third diameter may be about equal to the second diameter) (wherein "about" as used in this sentence refers only to +/−0.01 inches (0.0254 cm)).

In various embodiments, chair 100 may comprise one or more armrests 160. For example, chair 100 may comprise a first armrest 160-1 (e.g., a right armrest) and a second armrest 160-2. Each armrest 160 may be sized and shaped to receive an arm (or a portion of an arm) of a user sitting within chair 100. For example, while sitting in chair 100 a user may rest her right arm on first armrest 160-1 and/or her left arm on second armrest 160-2. In some embodiments, a user of chair 100 may also position or place an object on an armrest 160 while sitting in chair 100.

In various embodiments, first armrest 160-1 may be positioned on a right side of chair 100 between front frame 110 and first outer support member 130-1. First armrest 160-1 may be coupled at a front end (e.g., a first armrest front end) to front frame 110. First armrest 160-1 may be coupled at a rear end (e.g., a first armrest rear end) to first outer support member 130-1. In some embodiments, first armrest 160-1 may be positioned perpendicular to one or both of front frame 110 and/or first outer support member 130-1.

In various embodiments, first armrest 160-1 may comprise an inner armrest member 165-1 and an outer armrest member 167-1. Inner armrest member 165-1 and outer armrest member 167-1 may define a perimeter of first armrest 160-1. Inner armrest member 165-1 may be positioned inward from outer armrest member 167-1. Outer armrest member 167-1 may be positioned outward from inner armrest member 165-1. In some embodiments, outer armrest member 167-1 may be parallel to inner armrest member 165-1. In some embodiments, outer armrest member 167-1 may be vertically offset from inner armrest member 165-1.

In various embodiments, inner armrest member 165-1 and outer armrest member 167-2 may comprise different shapes (e.g., inner armrest member 165-1 may comprise a first shape, outer armrest member 167-1 may comprise a second shape, and the first shape may be different from the second shape). For example, inner armrest member 165-1 may comprise a straight shape (e.g., a straight line) and outer armrest member 167-1 may comprise a curved shape (e.g., a bent shape, a bowed shape, etc.). The curved shape of outer armrest member 167-1 may curve outward relative to inner armrest member 165-1.

In various embodiments, each of inner armrest member 165-1 and outer armrest member 167-2 may be coupled directly to front frame 110 and/or first outer support member 130-1. In various embodiments, one of inner armrest member 165-1 and outer armrest member 167-2 may be coupled to the other of inner armrest member 165-1 and outer armrest member 167-2, and the other of inner armrest member 165-1 and outer armrest member 167-2 may be coupled directly to front frame 110 and/or first outer support member 130-1.

In various embodiments, each coupling (e.g., coupling point) between an armrest 160 and a support member 120 and/or front frame 110 may comprise any suitable or desired type of coupling. For example, armrests 160 may be fixably coupled or removably coupled to a respective support member 120 and/or front frame 110. As a further example, armrests 160 may be coupled to a respective support member 120 and/or front frame 110 via welding, an adhesive, and/or the like. As a further example, armrests 160 may be coupled to a respective support member 120 and/or front frame 110 using a rope, a weave, a thread, and/or the like.

In various embodiments, each armrest 160 may comprise any suitable and/or desired material. For example, each armrest 160 may comprise a rigid material. Each armrest 160 may comprise a wood material. Each armrest 160 may comprise a metal material, such as stainless steel, steel, aluminum, and/or the like. In some embodiments, each armrest 160 may comprise a reinforced steel material (e.g., rebar). In some embodiments, each armrest 160 may comprise an about ⅜-inch (0.9525 cm) steel rebar. In some embodiments, armrests 160 may comprise a same material as front frame 110, support members 120, and/or cross members 150. In some embodiments, armrests 160 may comprise a material having a diameter less than a diameter of a material of front frame 110 (e.g., front frame 110 may comprise a first material having a first diameter, armrests 160 may comprise a fourth material having a fourth diameter, and the first diameter may be greater than the fourth diameter). In some embodiments, armrests 160 may comprise a material having a diameter about equal to a diameter of a material of support members 120 and/or cross members 150 (e.g., support members 120 may comprise a second material having a second diameter, cross members 150 may comprise a third material having a third diameter, armrests 160 may comprise a fourth material having a fourth diameter, and the fourth diameter may be about equal to the second diameter and the third diameter) (wherein "about" as used in this sentence refers only to +/−0.01 inches (0.0254 cm)).

In various embodiments, chair 100 may comprise a first side opening 135 (e.g., a right side opening) and a second side opening 145 (e.g., a left side opening). Each side opening 135, 145 may be in fluid communication with an interior of chair 100 and front opening 115 (e.g., first side opening 135, an interior of chair 100, front opening 115, and second side opening 145 are each and all in fluid communication). First side opening 135 may be defined by front frame 110 and first outer support member 130-1 (e.g., a perimeter of first side opening 135 may be defined by front frame 110 and first outer support member 130-1). First side opening 135 may be defined by a portion of front frame 110 between first end 131-1 and second end 131-2 of first outer support member 130-1, and first outer support member 130-1. Second side opening 145 may be defined by front frame 110 and second outer support member 130-2 (e.g., a perimeter of second side opening 145 may be defined by front frame 110 and second outer support member 130-2). Second side opening 145 may be defined by a portion of front frame 110 between first end 132-1 and second end 132-2 of second outer support member 130-2, and second outer support member 130-2.

In various embodiments, first side opening 135 may be intersected by first armrest 160-1. In that regard, first side opening 135 may comprise a plurality of different openings (e.g., sections) created by the intersection of first armrest 160-1 through first side opening 135. For example, first side opening 135 may comprise a first side top opening 137-1 and a first side bottom opening 137-2. First side top opening 137-1 may define first side opening 135 above first armrest

160-1. First side bottom opening 137-2 may define first side opening 135 below first armrest 160-1.

First side top opening 137-1 may be defined by front frame 110, first outer support member 130-1, and a top surface of first armrest 160-1 (e.g., a perimeter of first side top opening 137-1 may be defined by front frame 110, first outer support member 130-1, and a top surface of first armrest 160-1). First side top opening 137-1 may be defined by a portion (e.g., a first frame portion) of front frame 110 between the coupling of first end 131-1 of first outer support member 130-1 to front frame 110 and the coupling of first armrest 160-1 to front frame 110, a portion (e.g., a first member portion) of first outer support member 130-1 between the coupling of first end 131-1 of first outer support member 130-1 to front frame 110 and the coupling of first armrest 160-1 to first outer support member 130-1, and a top surface of first armrest 160-1.

First side bottom opening 137-2 may be defined by front frame 110, first outer support member 130-1, and a bottom surface of first armrest 160-1 (e.g., a perimeter of first side bottom opening 137-2 may be defined by front frame 110, first outer support member 130-1, and a bottom surface of first armrest 160-1). First side bottom opening 137-2 may be defined by a portion (e.g., a second frame portion) of front frame 110 between the coupling of second end 131-2 of first outer support member 130-1 to front frame 110 and the coupling of first armrest 160-1 to front frame 110, a portion (e.g., a second member portion) of first outer support member 130-1 between the coupling of second end 131-2 of first outer support member 130-1 to front frame 110 and the coupling of first armrest 160-1 to first outer support member 130-1, and a bottom surface of first armrest 160-1.

In various embodiments, first side top opening 137-1 and first side bottom opening 137-2 may comprise different surface areas. For example, first side top opening 137-1 may comprise a first surface area and first side bottom opening 137-2 may comprise a second surface area. The first surface area may be greater than the second surface area. The first surface area may be twice as large as the second surface area. The first surface area may be greater than the second surface area but less than twice as large as the second surface area. The first surface area may be between 10% and 50% larger than the second surface area. The first surface area may be between 50% and 100% larger than the second surface area. The first surface area may be greater than 100% larger than the second surface area.

In various embodiments, second side opening 145 may be intersected by second armrest 160-2. In that regard, second side opening 145 may comprise a plurality of different openings (e.g., sections) created by the intersection of second armrest 160-2 through second side opening 145. For example, second side opening 145 may comprise a second side top opening 147-1 and a second side bottom opening 147-2. Second side top opening 147-1 may define second side opening 145 above second armrest 160-2. Second side bottom opening 147-2 may define second side opening 145 below second armrest 160-2.

Second side top opening 147-1 may be defined by front frame 110, second outer support member 130-2, and a top surface of second armrest 160-2 (e.g., a perimeter of second side top opening 147-1 may be defined by front frame 110, second outer support member 130-2, and a top surface of second armrest 160-2). Second side top opening 147-1 may be defined by a portion (e.g., a third frame portion) of front frame 110 between the coupling of first end 132-1 of second outer support member 130-2 to front frame 110 and the coupling of second armrest 160-2 to front frame 110, a portion (e.g., a third member portion) of second outer support member 130-2 between the coupling of first end 132-1 of second outer support member 130-2 to front frame 110 and the coupling of second armrest 160-2 to second outer support member 130-2, and a top surface of second armrest 160-2.

Second side bottom opening 147-2 may be defined by front frame 110, second outer support member 130-2, and a bottom surface of second armrest 160-2 (e.g., a perimeter of second side bottom opening 147-2 may be defined by front frame 110, second outer support member 130-2, and a bottom surface of second armrest 160-2). Second side bottom opening 147-2 may be defined by a portion (e.g., a fourth frame portion) of front frame 110 between the coupling of second end 132-2 of second outer support member 130-2 to front frame 110 and the coupling of second armrest 160-2 to front frame 110, a portion (e.g., a fourth member portion) of second outer support member 130-2 between the coupling of second end 132-2 of second outer support member 130-2 to front frame 110 and the coupling of second armrest 160-2 to second outer support member 130-2, and a bottom surface of second armrest 160-2.

In various embodiments, second side top opening 147-1 and second side bottom opening 147-2 may comprise different surface areas. For example, second side top opening 147-1 may comprise a third surface area and second side bottom opening 147-2 may comprise a fourth surface area. The third surface area may be greater than the fourth surface area. The third surface area may be twice as large as the fourth surface area. The third surface area may be greater than the fourth surface area but less than twice as large as the fourth surface area. The third surface area may be between 10% and 50% larger than the fourth surface area. The third surface area may be between 50% and 100% larger than the fourth surface area. The third surface area may be greater than 100% larger than the fourth surface area.

In various embodiments, first side top opening 137-1 may be similar to second side top opening 147-1. First side top opening 137-1 and second side top opening 147-1 may share similar sizes, shapes, and physical characteristics. First side top opening 137-1 may be symmetrical to second side top opening 147-1. The first surface area of first side top opening 137-1 may be about the same as the third surface area of second side top opening 147-1. The first surface area of first side top opening 137-1 may be greater than the fourth surface area of second side bottom opening 147-2. The third surface area of second side top opening 147-1 may be greater than the second surface area of first side bottom opening 137-2.

In various embodiments, first side bottom opening 137-2 may be similar to second side bottom opening 147-2. First side bottom opening 137-2 and second side bottom opening 147-2 may share similar sizes, shapes, and physical characteristics. First side bottom opening 137-2 may be symmetrical to second side bottom opening 147-2. The second surface area of first side bottom opening 137-2 may be about the same as the fourth surface area of second side bottom opening 147-2. The second surface area of first side bottom opening 137-2 may be less than the third surface area of second side top opening 147-1. The fourth surface area of second side bottom opening 147-2 may be less than the first surface area of first side top opening 137-1.

In various embodiments, chair 100 may comprise an anchor 170. Anchor 170 may be configured to allow chair 100 to be suspended (e.g., hung) from an object. For example, anchor 170 may be configured to couple to a chain, a rope, or the like suspended from a stationary object. As a further example, anchor may be configured to couple to a suspension frame, a stationary object, or the like.

Anchor 170 may be coupled to a top portion of front frame 110. Anchor 170 may be coupled to front frame 110 between third top coupling point 103 and fourth top coupling point 104. In various embodiments, a center point of anchor 170 (e.g., an anchor center point) may be aligned with a center point between third top coupling point 103 and fourth top coupling point 104. In various embodiments, anchor 170 may be coupled to front frame 110 at a location equidistant from each of third top coupling point 103 and fourth top coupling point 104. In various embodiments, anchor 170 may couple to front frame 110 at a location independent of first top coupling point 101, second top coupling point 102, third top coupling point 103, and fourth top coupling point 104. In that regard, the coupling of anchor 170 to front frame 110 may be a different location than each of first top coupling point 101, second top coupling point 102, third top coupling point 103, and fourth top coupling point 104.

In various embodiments, each coupling (e.g., coupling point) between anchor 170 and front frame 110 may comprise any suitable or desired type of coupling. For example, anchor 170 may be fixably coupled or removably coupled to front frame 110. As a further example, anchor 170 may be coupled to front frame 110 via welding, an adhesive, and/or the like. As a further example, anchor 170 may be coupled to front frame 110 using a rope, a weave, a thread, and/or the like.

In various embodiments, anchor 170 may be rotatably coupled to front frame 110. A rotatable coupling may enable chair 100 to rotate (e.g., swivel, turn, etc.) while anchor 170 is coupled to an object to suspend chair 100. Anchor 170 may comprise any suitable component to enable the rotatable coupling, such as, for example, a ball bearing mount, a swivel mount, and/or the like.

In various embodiments, anchor 170 may comprise any suitable or desired shape. Anchor 170 may comprise a shape configured to form an opening in response to anchor 170 being coupled to front frame 110. For example, anchor 170 may comprise a U-shape, a C-shape, a D-shape, and/or the like.

In various embodiments, anchor 170 may comprise any suitable and/or desired material. For example, anchor 170 may comprise a rigid material. Anchor 170 may comprise a wood material. Anchor 170 may comprise a metal material, such as stainless steel, steel, aluminum, and/or the like. In some embodiments, anchor 170 may comprise a reinforced steel material (e.g., rebar). In some embodiments, anchor 170) may comprise an about ⅜-inch (0).9525 cm) steel rebar. In some embodiments, anchor 170 may comprise a same material as front frame 110, support members 120, cross members 150, and/or armrests 160. In some embodiments, anchor 170 may comprise a material having a diameter less than a diameter of a material of front frame 110 (e.g., front frame 110) may comprise a first material having a first diameter, anchor 170 may comprise a fifth material having a fifth diameter, and the first diameter may be greater than the fifth diameter). In some embodiments, anchor 170 may comprise a material having a diameter about equal to a diameter of a material of support members 120, cross members 150, and/or armrests 160) (e.g., support members 120 may comprise a second material having a second diameter, cross members 150 may comprise a third material having a third diameter, armrests 160) may comprise a fourth material having a fourth diameter, anchor 170 may comprise a fifth material having a fifth diameter, and the fifth diameter may be about equal to the second diameter, the third diameter, and the fourth diameter) (wherein "about" as used in this sentence refers only to +/−0.01 inches (0.0254 cm)).

Figure 2A:
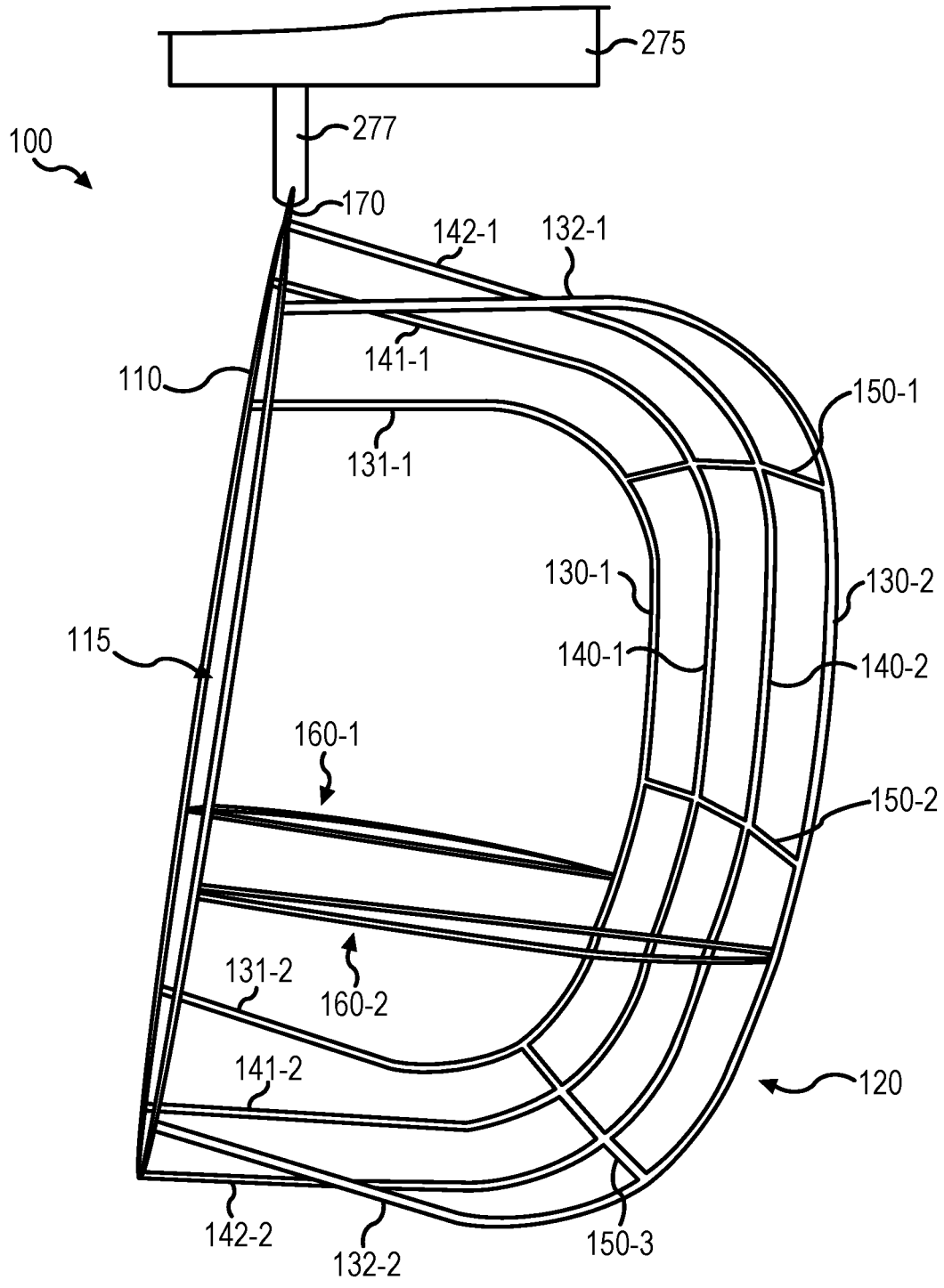
FIG. 2A illustrates a side perspective view of a chair in a rest position, in accordance with various embodiments.
Figure 2B:
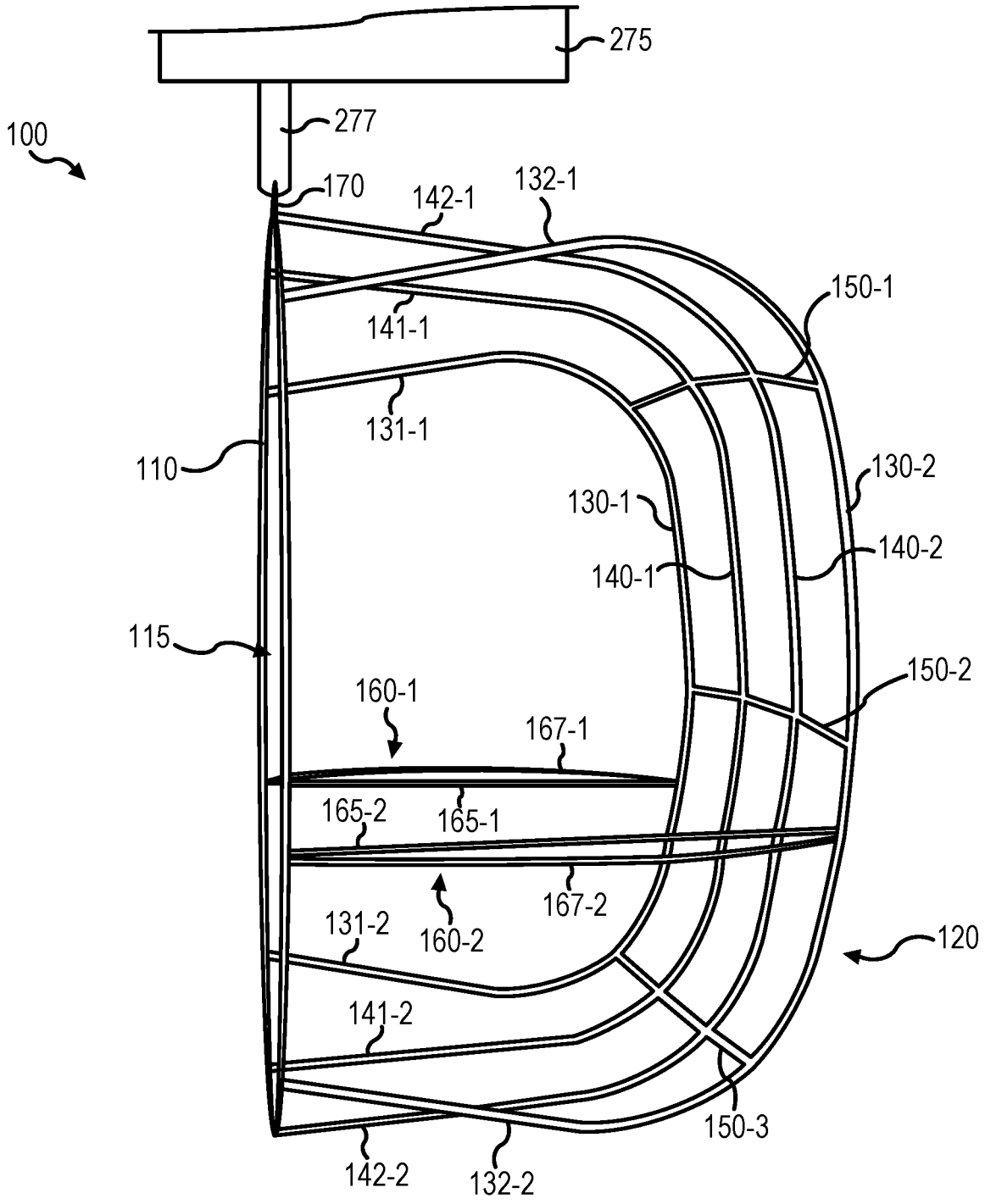
FIG. 2B illustrates a side perspective view of a chair in a load position, in accordance with various embodiments.

In various embodiments, and with reference to FIGS. 2A and 2B, chair 100 may be configured to transition between a rest position (e.g., a first position, an open position, etc.) to a load position (e.g., a second position, a seating position, etc.). As previously discussed, chair 100 may be configured to suspend from an external support structure 275. External support structure 275 may comprise any object capable of coupling to and/or supporting chair 100. For example, external support structure 275 may comprise a frame, a tree, a ceiling, a building beam, and/or the like. A connecting structure 277 may be coupled at a first end to external support structure 275 and at a second end to anchor 170 of chair 100. Connecting structure 277 may comprise any suitable material, component, and/or the like configured to suspend chair 100 from external support structure 275. For example, connecting structure 277 may comprise a rope, a chain, a linking structure, and/or the like. In some embodiments, chair 100, external support structure 275, and/or connecting structure 277 may be collectively referred to as a chair system (e.g., a hanging chair system, a chair support system, etc.). In that regard, a chair system may comprise chair 100, external support structure 275, and/or connecting structure 277.

With reference to FIG. 2A, chair 100 is depicted in the rest position. In the rest position, a bottom portion of front frame 110 may be tilted axially forward. For example, the bottom portion of front frame 110 may be axially forward a top portion of front frame 110 (e.g., the top portion of front frame 110 is axially rearward the bottom portion of front frame 110). In the rest position, the top portion of front frame 110 and the bottom portion of front frame 110 may be misaligned (e.g., not aligned within a straight vertical plane relative to anchor 170 and connecting structure 277). In the rest position, armrests 160 may not be parallel to a ground (e.g., a surface chair 100 is suspended over) and/or to external support structure 275.

With reference to FIG. 2B, chair 100 is depicted in a load position. Chair 100 may be configured to transition from the rest position to the load position in response to chair 100 receiving a load. As discussed herein, a "load" may refer to weight being transferred to an interior of chair 100. For example, a user sitting within chair 100 may transfer a load to chair 100. As a further example, a user placing an object with weight into an interior of chair 100 may transfer a load to chair 100. Chair 100 may comprise a different orientation in the load position relative to the rest position (e.g., chair 100 comprises a first orientation in the rest position, chair 100 comprises a second orientation in the load position, and the first orientation is different from the second orientation).

In the load position, a bottom portion of front frame 110 may be tilted axially rearward relative to chair 100 in the rest position. In the load position, the top portion of front frame 110 and the bottom portion of front frame 110 may be substantially aligned (e.g., substantially aligned within a straight vertical plane relative to anchor 170 and connecting structure 277). In the load position, the bottom portion of front frame 110 may be closer in axially proximity to the top portion of front frame 110 compared to chair 100 in the rest position. In the load position, armrests 160 may be substantially parallel to a ground (e.g., a surface chair 100 is suspended over) and/or to external support structure 275.

In various embodiments, by transitioning from the rest position to the load position chair 100 may be configured optimize comfort, recline, and body position for a user sitting within chair 100 (e.g., in the load position). In that regard, chair 100 may be sized, shaped, and oriented in consideration of the difference in weight of chair 100 in the rest position compared to the load position. By offering a different orientation in the rest position, chair 100 may transition to a more optimal position for user comfort in response to the user sitting in chair 100 (and transitioning to the load state).

Figure 3:
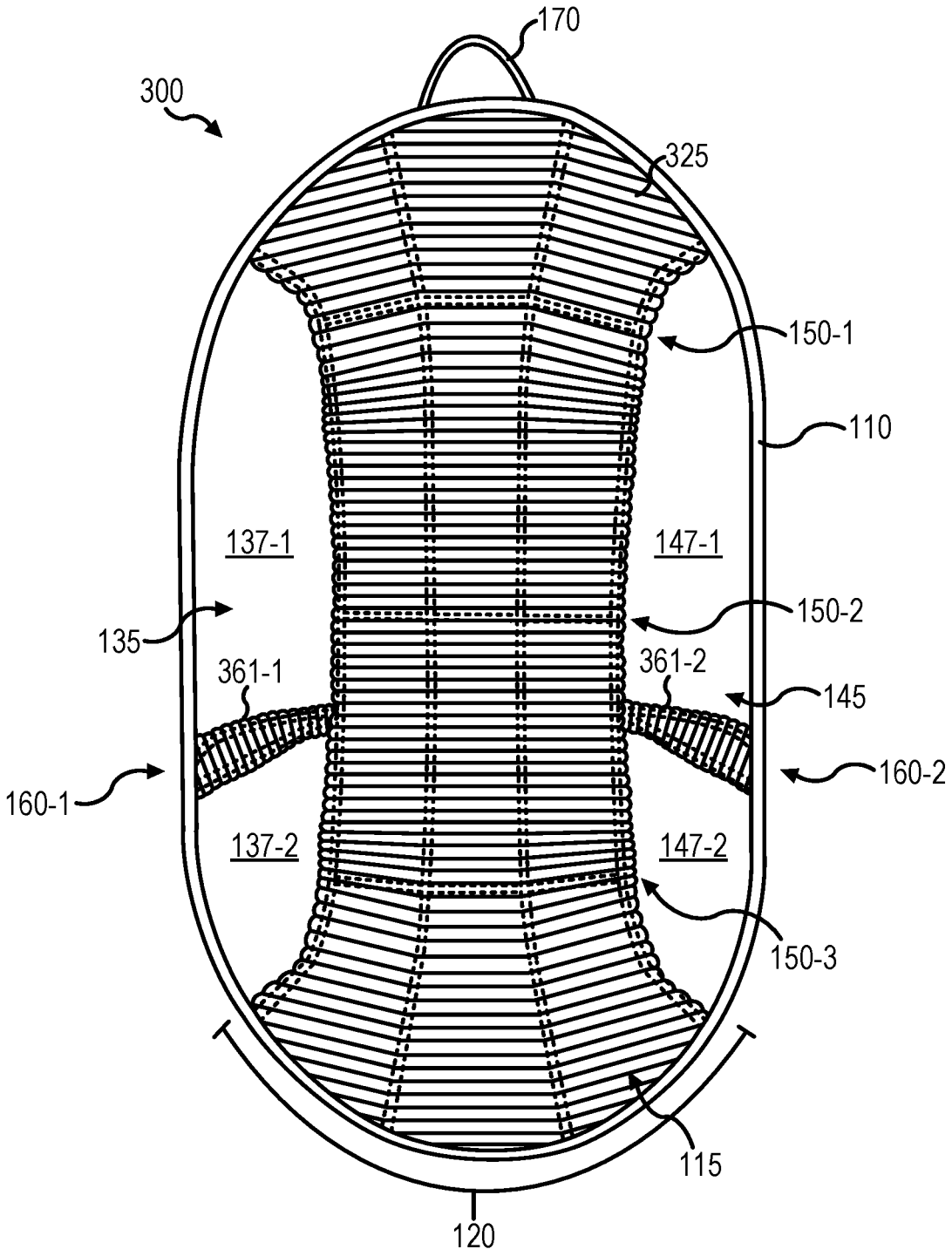
FIG. 3 illustrates a front perspective view of a chair with a covering, in accordance with various embodiments.

In various embodiments, and with refence to FIG. 3, a chair 300 may comprise one or more surface coverings. Chair 300 may be similar to, or comprise similar components as, chair 100, with brief reference to FIGS. 1A-1C. The one or more surface coverings may be coupled to one or more frames and/or members of chair 300. In that respect, the one or more surface coverings may be configured to form one or more surfaces (e.g., platforms, seats, etc.) of chair 300. The one or more surface coverings may also be configured to at least partially cover (e.g., obstruct) surfaces of the one or more frames and/or members of chair 300. As shown in FIG. 3, support members 120, cross members 150 (e.g., first cross member 150-1, second cross member 150-2, third cross member 150-3), and armrests 160 (e.g., first armrest 160-1, second armrest 160-2) are depicted in dashed lines to show the relative positions of each component under a respective surface covering. Although not depicted in FIG. 3, in some embodiments, front frame 110 and/or anchor 170 may also be covered by and/or coupled to a surface covering.

In various embodiments, chair 300 may comprise a support covering 325. Support covering 325 may be coupled to an outer surface of support members 120. Support covering 325 may be coupled between one or more support members 120. Support covering 325 may be coupled to support members 120 from a top portion of front frame 110 to a bottom portion of front frame 110. Support covering 325 may cover and/or obstruct surfaces of support members 120. Support covering 325 may be configured to form a cover over support members 120.

Support covering 325 may be configured to form a seat, a backrest, and or a shade (e.g., roof, sun cover, overhead covering, etc.) in chair 300. For example, support covering 325 may form the seat from the bottom portion of front frame 110 proximate to third cross member 150-3. Support covering 325 may form the backrest from proximate third cross member 150-3 to proximate second cross member 150-2. Support covering 325 may form the shade from proximate second cross member 150-2 to proximate first cross member 150-1.

In some embodiments, support covering 325 may provide chair 300 and a user sitting within chair 300 protection from elements (e.g., sunlight, rain, etc.). In some embodiments, support covering 325 may be configured to provide a comfortable and/or smooth surface for a user while sitting within chair 300.

In various embodiments, support covering 325 may be coupled to support members 120 using any suitable process or technique. For example, support covering 325 may be wrapped and/or weaved on or between support members 120. As a further example, support covering 325 may be coupled to support members 120 with an adhesive or via other chemical means. As a further example, support covering 325 may be coupled to support members 120 via a mechanical fastener, a hook and loop fastener, and/or the like. As a further example, support covering 325 may be stretched over support members 120 and coupled to a top portion and/or a bottom portion of front frame 110 to remain in position covering support members 120.

In various embodiments, support covering 325 may comprise any suitable and/or desired material. Support covering 325 may comprise a solution-dyed acrylic material, a vinyl mesh, a polyester fabric, a rope material, a netting material, and/or any other suitable material. Support covering 325 may comprise a synthetic rattan material that is wrapped and/or weaved over support members 120. The synthetic rattan material may be wrapped and/or weaved in specific patterns and/or directions. For example, the synthetic rattan material may be wrapped and/or weaved in a circular pattern over support members 120, in a side-to-side vertical pattern over cross members 150, and/or the like. The synthetic rattan material may be wrapped and/or weaved in a generally horizontal direction over support members 120.

In various embodiments, chair 300 may comprise one or more armrest coverings 361. For example, chair 300 may comprise a first armrest covering 361-1 coupled to an outer surface of first armrest 160-1 and a second armrest covering 361-2 coupled to an outer surface of second armrest 160-2. Armrest coverings 361 may be coupled between one or more members or each armrest 160. Armrest coverings 361 may be coupled over an entirety of each armrest 160. Armrest coverings 361 may cover and/or obstruct surfaces of each armrest 160. Armrest coverings 361 may be configured to form a cover over each armrest 160.

Armrest coverings 361 may be configured to form a surface (e.g., an armrest surface, a resting surface, etc.) over each armrest 160. For example, first armrest covering 361-1 may form a surface over first armrest 160-1 and second armrest covering 361-2 may form a surface over second armrest 160-2. In some embodiments, armrest coverings 361 may be configured to provide a comfortable and/or smooth surface for a user's arms while the user is sitting within chair 300.

In various embodiments, armrest coverings 361 may be coupled to each armrest 160 using any suitable process or technique. For example, armrest coverings 361 may be wrapped and/or weaved on or between members of each armrest 160. As a further example, armrest coverings 361 may be coupled to each armrest 160 with an adhesive or via other chemical means. As a further example, armrest coverings 361 may be coupled to each armrest 160 via a mechanical fastener, a hook and loop fastener, and/or the like. As a further example, armrest coverings 361 may be stretched over each armrest 160 and coupled to a middle portion of front frame 110 and a middle portion of a respective outer support member 130 to remain in position covering each armrest 160.

In various embodiments, armrest coverings 361 may comprise any suitable and/or desired material. Armrest coverings 361 may comprise a solution-dyed acrylic material, a vinyl mesh, a polyester fabric, a rope material, a netting material, and/or any other suitable material. Armrest coverings 361 may comprise a synthetic rattan material that is wrapped and/or weaved over each armrest 160. The synthetic rattan material may be wrapped and/or weaved in specific patterns and/or directions. For example, the synthetic rattan material may be wrapped and/or weaved in a circular pattern over each armrest 160 and/or the like. The synthetic rattan material may be wrapped and/or weaved in a generally horizontal direction over each armrest 160.

In various embodiments, coverings of chair 300 may form structures, surfaces, and/or platforms while not obstructing openings of chair 300. In that regard, front opening 115, first side opening 135 (including both first side top opening 137-1 and first side bottom opening 137-2), and second side opening 145 (including both second side top opening 147-1 and second side bottom opening 147-2) may remain open, in fluid communication with each other, and unobstructed by coverings (e.g., support covering 325, armrest coverings 361).

Figure 4:
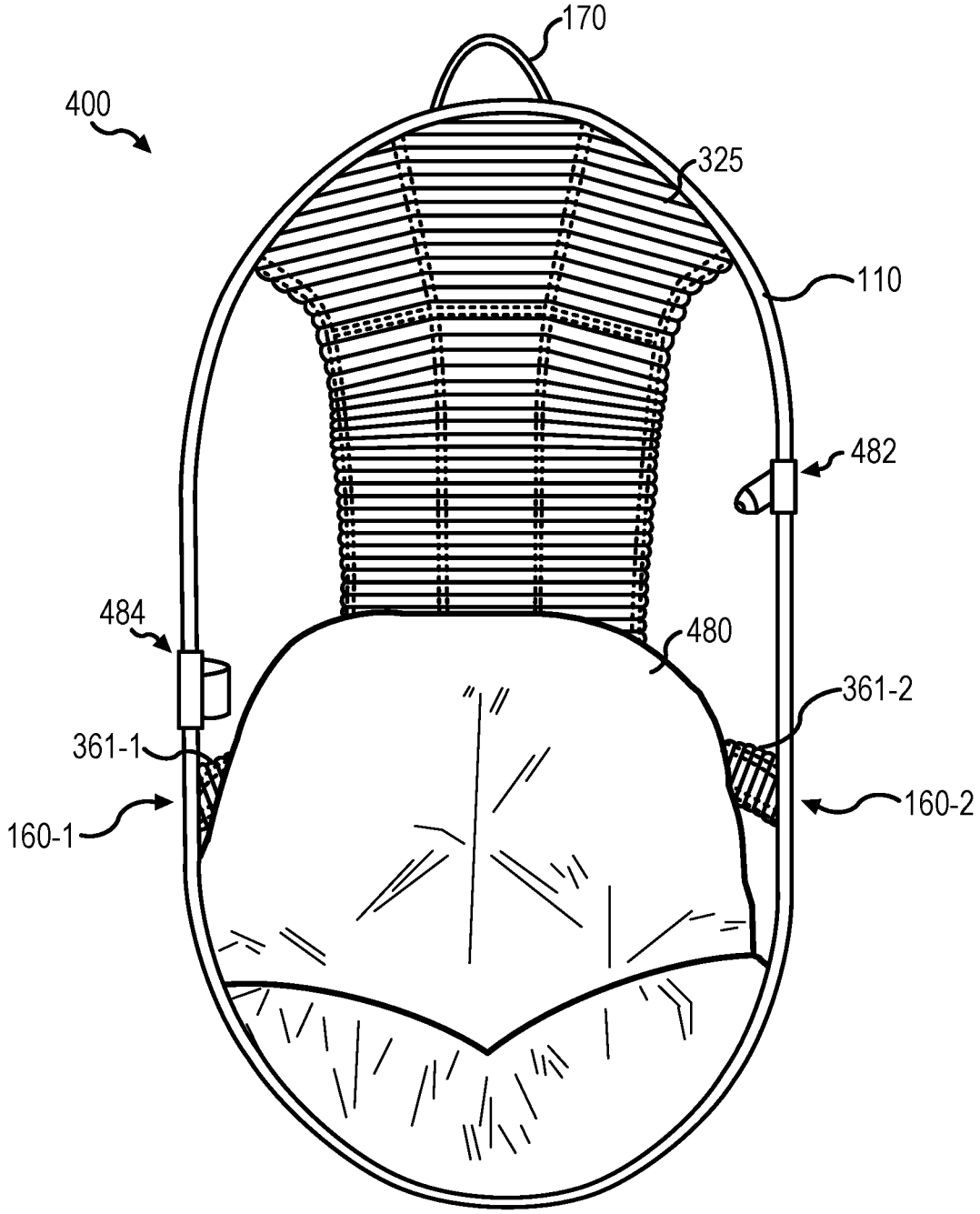
FIG. 4 illustrates a front perspective view of a chair with accessories, in accordance with various embodiments.

In various embodiments, and with reference to FIG. 4, a chair 400 may include one or more accessories. Chair 400 may be similar to, or comprise similar components as, and other chair disclosed herein (e.g., chair 100, with brief reference to FIGS. 1A-1C: chair 300, with brief reference to FIG. 3: etc.).

In various embodiments, chair 400 may comprise a cushion 480. Chair 400 may comprise any suitable or desired number of cushions 440. Chair 400 may comprise a cushion 480 defining a seat and a backrest. Chair 400 may comprise a plurality of cushions 480 including a seat cushion and a backrest cushion. Cushion 480 may be positioned or coupled to the interior of chair 480. For example, cushion 480 may be positioned or coupled to support covering 325. Cushion 480 may comprise any suitable type of cushion. Cushion 480 may comprise an object having an outer protective surface enclosing a mass of soft material (e.g., stuffing, feathers, foam, etc.). Cushion 480 may comprise a pillow, a pad, and/or the like. Cushion 480 may be configured to provide a comfortable sitting and up resting support for a user of chair 400)

In various embodiments, chair 400 may comprise a light accessory 482. Light accessory 480 may be coupled to front frame 110. Light accessory 482 may be translatably and/or rotatably coupled to front frame 110 such that light accessory 482 may translate up and/or down on front frame 110. Light accessory 482 may comprise any suitable light source. For example, light accessory 482 may comprise a light emitting diode (LED), a flashlight, and/or the like. In some embodiments, light accessory 482 may comprise a reading light configured to provide a source of light to a user sitting within chair 400.

In various embodiments, light accessory 482 may comprise an external power source located external chair 400. In that respect, an electrical connection (e.g., electrical cabling) from light accessory 482 to the external power source may be routed through chair 400. In some embodiments, the electrical connection may be routed through an interior of front frame 110. The electrical connection may exit front frame 110 proximate to anchor 170. In some embodiments, the electrical connection may be routed between front frame 110 and a surface covering that covers front frame 110. The electrical connection may exit the position between front frame 110 and the surface covering proximate to anchor 170.

In various embodiments, light accessory 482 may comprise an onboard power source. For example, a power source for light accessory 482 may be located within light accessory 482. As a further example, a power source may be located within chair 100 (e.g., within a support member, coupled to a support member, coupled to an armrest, etc.). Light accessory 482 may be electrically coupled to the power source. As a further example, a solar panel may be coupled to chair 400. Light accessory 482 may be electrically coupled to the solar panel and configured to receive electrical power from the solar panel.

In various embodiments, chair 400 may comprise a holding accessory 484. Holding accessory 484 may be coupled to front frame 110. Holding accessory 484 may be translatably and/or rotatably coupled to front frame 110 such that holding accessory 484 may translate up and/or down on front frame 110. Holding accessory 484 may comprise a holding object configured to hold and/or support a cup, a drink, a phone, a book, a notebook, a snack, and/or the like. Holding accessory 484 may comprise any suitable size, shape, and/or orientation.

In some embodiments, holding accessory 484 may comprise a metal circular ring welded to front frame 110. The metal circular ring may be welded to front frame 110 at a location radially upward from first armrest 160-1 (or second armrest 160-2). The metal circular ring may comprise a small gap in the ring to enable holding accessory 484 expand and/or contract to receive different sized cups and beverages. The metal circular ring may be at least partially covered by a covering (e.g., as discussed with reference to FIG. 3).

Figure 5:
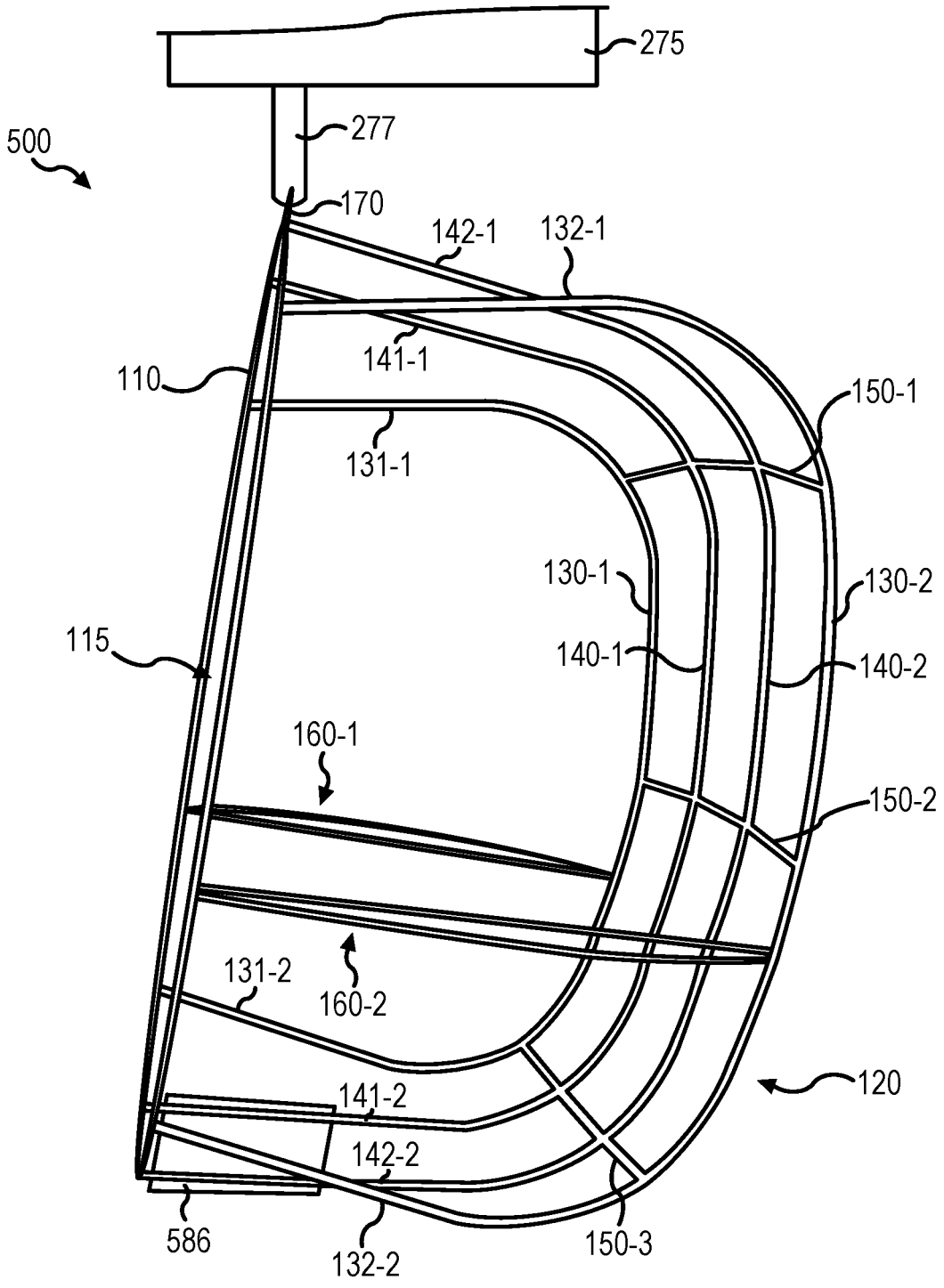
FIG. 5 illustrates a side perspective view of a chair with a deployable footrest, in accordance with various embodiments.

In various embodiments, and with reference to FIG. 5, a chair 500 may comprise a footrest 586. Chair 500 may be similar to, or comprise similar components as, and other chair disclosed herein (e.g., chair 100, with brief reference to FIGS. 1A-1C; chair 300, with brief reference to FIG. 3: chair 400, with brief reference to FIG. 4: etc.).

In various embodiments, footrest 586 may comprise any suitable or desired type of footrest. Although depicted in FIG. 5 as comprising a thin, square shape, footrest 586 may comprise any suitable size, shape, and/or orientation. For example, footrest 586 may comprise a platform, an extension, a stool, a block, and/or the like.

In various embodiments, footrest 586 may be coupled to a bottom surface of chair 500. Footrest 586 may be coupled to a bottom surface of first inner support member 140-1 and/or second inner support member 140-2. Footrest 586 may be coupled to a bottom surface of second end 141-2 of first inner support member 140-1 and/or a bottom surface of second end 142-2 of second inner support member 140-2.

In various embodiments, footrest 586 may be removably coupled to the bottom surface of chair 500. In that regard, footrest 586 may be decoupled and used by a user with chair 500, and then recoupled to remain with chair 500. Footrest 586 may be removably coupled to chair 500 using any suitable or desired technique. For example, in some embodiments, chair 500 may comprise a storage box on a bottom surface of chair 500. Footrest 586 may be stored, removed, and repositioned in the storage box. As a further example, in some embodiments, chair 500 may comprise rails, tracks, slides, or the like. Footrest 586 may engage the rails, tracks, slides, or the like to couple to chair 500. Footrest 586 may be disengaged from the rails, tracks, slides, or the like to decouple from chair 500.

In various embodiments, footrest 586 may be translatably, slidably, and/or rotatably coupled to the bottom surface of chair 500. In that regard, footrest 586 may be configured to translate, slide, and/or rotate between a stowed position (e.g., a first footrest position, a beneath position, etc.) and a deployed position (e.g., a second footrest position, a forward position, etc.). In the stowed position, footrest 586 may be positioned under (e.g., beneath, radially downward) chair 500 (e.g., as depicted in FIG. 5). In the deployed position, at least a portion of footrest 586 may be positioned forward (e.g., axially forward) of at least a portion of chair 500. In the deployed position, footrest 586 may be oriented such that a user may rest her feet on footrest 586 while sitting within chair 500.

In some embodiments, footrest 586 may be configured to translate between the stowed position and the deployed position via a slide, a rail, a translatable member, and/or the like coupled to a bottom of chair 500. In some embodiments, footrest 586 may be configured to slide between the stowed position and the deployed position via a slide, a rail, a slidable member, and/or the like coupled to a bottom of chair

500. In some embodiments, footrest 586 may be configured to rotate between the stowed position and the deployed position via a hinge, a rotatable coupling, and/or the like coupled to a bottom of chair 500.

As previously discussed herein, in some embodiments components of a chair may be removably coupled to one or more other components of the chair. Removable couplings may enable the chair to be assembled and disassembled easily during transit and other events. In some embodiments, removable couplings may decrease shipping costs during sale and/or transmit of the chair (e.g., by enabling components of the chair to be separated to take less surface area in a package compared to a fully assembled chair). For example, in various embodiments and with reference to FIG. 6, a chair 600 with removable couplings is disclosed.

In various embodiments, chair 600 may comprise any suitable number of removable couplings. Each removable coupling may comprise any suitable type of removable coupling. For example, one or more removable couplings may comprise a hook and latch coupling, a clamp coupling, a screw coupling, an insertion coupling, a push fitting coupling, a pin coupling, a connecting link coupling, a safety lock pin coupling, a clevis pin coupling, a quick release coupling, a spring release coupling, a pin and clip coupling, and/or any other suitable type of removable coupling. As a further example, one or more removable couplings may comprise a welded fastener. The welded fastener may be configured to receive two or more members of chair 600. The welded fastener may be configured to receive an end or portion of two or more members of chair 600. For example, a first end or portion of a first member may be inserted into the welded fastener and a second end or portion of a second member may be inserted into the welded fastener to couple the first member to the second member. Respective members may be secured within the welded fastener using any suitable technique, such as, for example, using a pin and/or a clip. For example, a pin may be inserted through the welded fastener and a respective member to secure the respective member into the welded fastener. As a further example, the welded fastener may comprise a mounted clip that may engage a surface of a respective member to secure the respective member into the welded fastener. In some embodiments, a welded fastener may comprise a ½-inch (1.27 cm) metal tubing. The welded fastener may comprise a square tubing, a cylindrical tubing, and/or any other tubing sized and shaped to receive two or more members of chair 600.

In various embodiments, one or more coupling points of chair 600 may comprise a removable coupling. For example, top end 131-1 of first outer support member 130-1 may be removably coupled to front frame 110 at a first top removable coupling point 601 (e.g., a first removable coupling point). Top end 132-1 of second outer support member 130-2 may be removably coupled to front frame 110 at a second top removable coupling point 602 (e.g., a second removable coupling point). Top end 141-1 of first inner support member 140-1 may be removably coupled to front frame 110 at a third top removable coupling point 603 (e.g., a third removable coupling point). Top end 142-1 of second inner support member 140-2 may be removably coupled to front frame 110 at a fourth top removable coupling point 604 (e.g., a fourth removable coupling point). In some embodiments, one or more top removable coupling points may be similar to other coupling points disclosed herein.

As a further example, bottom end 131-2 of first outer support member 130-1 may be removably coupled to front frame 110 at a first bottom removable coupling point 611 (e.g., a fifth removable coupling point). Bottom end 132-2 of second outer support member 130-2 may be removably coupled to front frame 110 at a second bottom removable coupling point 612 (e.g., a sixth removable coupling point). Bottom end 141-2 of first inner support member 140-1 may be removably coupled to front frame 110 at a third bottom removable coupling point 613 (e.g., a seventh removable coupling point). Bottom end 142-2 of second inner support member 140-2 may be removably coupled to front frame 110 at a fourth bottom removable coupling point 614 (e.g., an eighth removable coupling point). In some embodiments, one or more bottom removable coupling points may be similar to other coupling points disclosed herein.

As a further example, one or more cross members 150 may be removably coupled to chair 600. One or more cross members 150 may be removably coupled to one or more support members 120. For example, first cross member 150-1 may be removably coupled to one or more support members 120, second cross member 150-2 may be removably coupled to one or more support members 120, and/or third cross member 150-3 may be removably coupled to one or more support members 120. Although depicted in FIG. 6 as only second cross member 150-2 being removably coupled to one or more support members 120, it should be understood that in some embodiments first cross member 150-1, second cross member 150-2, and/or third cross member 150-3 may be removably coupled to one or more support members 120.

Second cross member 150-2 may be removably coupled to first outer support member 130-1 at a first cross removable coupling point 691 (e.g., a ninth removable coupling point), to first inner support member 140-1 at a second cross removable coupling point 692 (e.g., a tenth removable coupling point), to second inner support member 140-2 at a third cross removable coupling point 693 (e.g., an eleventh removable coupling point), and/or to second outer support member 130-2 at a fourth cross removable coupling point 694 (e.g., a twelfth removable coupling point).

As a further example, each armrest 160) may be removably coupled to chair 600. Each armrest 160 may be removably coupled to front frame 110 and a respective outer support member 130. First armrest 160-1 may be removably coupled to first outer support member 130-1 at a first armrest removable coupling point 695 (e.g., a thirteenth removable coupling point). First armrest 160-1 may be removably coupled to front frame 110 at a second armrest removable coupling point 696 (e.g., a fourteenth removable coupling point). Second armrest 160-2 may be removably coupled to second outer support member 130-2 at a third armrest removable coupling point 698 (e.g., a fifteenth removable coupling point). Second armrest 160-2 may be removably coupled to front frame 110 at a second armrest removable coupling point 699 (e.g., a sixteenth removable coupling point).

In various embodiments, removable couplings of chair 600 may enable chair 600 to separate into one or more distinct components. For example, front frame 110 may be separated (e.g., removably coupled) from chair 600 via removable coupling points 601, 602, 603, 604, 611, 612, 613, 614, 696, and 699. First outer support member 130-1 may be separated (e.g., removably coupled) from chair 600 via removable coupling points 601, 611, 691, and 695. First inner support member 140-1 may be separated (e.g., removably coupled) from chair 600 via removable coupling points 603, 613, and 692. Second inner support member 140)-2 may be separated (e.g., removably coupled) from chair 600 via removable coupling points 604, 614, and 693. Second outer support member 130-2 may be separated (e.g., removably coupled) from chair 600 via removable coupling points 602, 612, 694, and 698. Second cross member 150-2 may be separated (e.g., removably coupled) from chair 600 via removable coupling points 691, 692, 693, and 694. Similarly, first cross member 150-1 and/or third cross member 150-3 may be separated (e.g., removably coupled) from chair 600 via removable coupling points on first outer support member 130-1, first inner support member 140-1, second inner support member 140-2, and second outer support member 130-2. First armrest 160-1 may be separated (e.g., removably coupled) from chair 600 via removable coupling points 695 and 696. Second armrest 160-2 may be separated (e.g., removably coupled) from chair 600 via removable coupling points 698 and 699.

In that regard, in some embodiments chair 600 may separate into ten separate and distinct components via the removable coupling points. The separation of relative components of chair 600 in this manner may enable chair 600 to compact in size (e.g., decrease in volumetric size compared to an assembled chair 600) to take less surface area in a package compared to a fully assembled chair.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures. The scope of the disclosures is accordingly to be limited by nothing other than the appended claims and their legal equivalents, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment: for example, A and B, A and C, B and C, or A and B and C.

In the detailed description herein, references to "various embodiments," "one embodiment," "an embodiment," "an example embodiment," "some embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments. Furthermore, no element, component, or method step in the present disclosure is intended to be dedicated to the public regardless of whether the element, component, or method step is explicitly recited in the claims. No claim element is intended to invoke 35 U.S.C. 112 (f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A hanging chair comprising:

a front frame defining a front opening;

a plurality of support members coupled to the front frame, wherein the plurality of support members extend from a top portion of the front frame to a bottom portion of the front frame, and wherein the plurality of support members extend axially rearward the front frame;

a first side opening defined between the front frame and a first outer support member of the plurality of support members;

a second side opening defined between the front frame and a second outer support member of the plurality of support members, wherein the first side opening, the second side opening, and the front opening are in fluid communication;

a first armrest coupled to the front frame and the first outer support member, wherein the first armrest intersects the first side opening, and wherein the intersection of the first armrest in the first side opening defines a first side top opening of the first side opening above the first armrest and a first side bottom opening of the first side opening below the first armrest; and a second armrest coupled to the front frame and the second outer support member, wherein the second armrest intersects the second side opening, and wherein the intersection of the second armrest in the second side opening defines a second side top opening of the second side opening above the second armrest and a second side bottom opening of the second side opening below the second armrest.

2. The hanging chair of claim 1, wherein the plurality of support members also comprise a first inner support member and a second inner support member, and wherein the first inner support member and the second inner support member are disposed between the first outer support member and the second outer support member.

3. The hanging chair of claim 2, wherein the first outer support member couples to the top portion of the front frame at a first coupling point, the second outer support member couples to the top portion of the front frame at a second coupling point, the first inner support member couples to the top portion of the front frame at a third coupling point, and the second inner support member couples to the top portion of the front frame at a fourth coupling point, and wherein the first coupling point, the second coupling point, the third coupling point, and the fourth coupling point comprise different locations on the front frame.

4. The hanging chair of claim 3, wherein the first coupling point and the second coupling point are radially inward from the third coupling point and the fourth coupling point.

5. The hanging chair of claim 3, further comprising an anchor coupled to the top portion of the front frame, wherein the anchor is disposed between the third coupling point and the fourth coupling point.

6. The hanging chair of claim 2, wherein the first outer support member couples to the bottom portion of the front frame at a fifth coupling point, the second outer support member couples to the bottom portion of the front frame at a sixth coupling point, the first inner support member couples to the bottom portion of the front frame at a seventh coupling point, and the second inner support member couples to the bottom portion of the front frame at an eighth coupling point, and wherein the fifth coupling point, the sixth coupling point, the seventh coupling point, and the eighth coupling point comprise different locations on the front frame.

7. The hanging chair of claim 6, wherein the fifth coupling point and the sixth coupling point are radially inward from the seventh coupling point and the eighth coupling point.

8. The hanging chair of claim 2, wherein each end of the first outer support member and the second outer support member is displaced at a first angle, wherein each end of the first inner support member and the second inner support member is displaced at a second angle, and wherein the first angle is different from the second angle.

9. The hanging chair of claim 8, wherein the first angle is less than the second angle.

10. The hanging chair of claim 1, wherein the first side top opening comprises a first surface area, wherein the first side bottom opening comprises a second surface area, and wherein the first surface area is greater than the second surface area.

11. The hanging chair of claim 1, wherein the second side top opening comprises a third surface area, wherein the second side bottom opening comprises a fourth surface area, and wherein the third surface area is greater than the fourth surface area.

12. The hanging chair of claim 1, wherein the first side top opening comprises a first surface area, wherein the first side bottom opening comprises a second surface area, wherein the second side top opening comprises a third surface area, wherein the second side bottom opening comprises a fourth surface area, wherein the first surface area is similar to the third surface area, and wherein the second surface area is similar to the fourth surface area.

13. A hanging chair system comprising:

an external support structure;

a connecting structure comprising a first end opposite a second end, wherein the first end is coupled to the external support structure; and a hanging chair coupled to the second end of the connecting structure, wherein the hanging chair is configured to suspend in the air in response to being coupled to the second end of the connecting structure, and wherein the hanging chair comprises:

a front frame defining a front opening;

a plurality of support members coupled to the front frame, wherein the plurality of support members extend from a top portion of the front frame to a bottom portion of the front frame, and wherein the plurality of support members extend axially rearward the front frame;

a first side opening defined between the front frame and a first outer support member of the plurality of support members; and a second side opening defined between the front frame and a second outer support member of the plurality of support members, wherein the first side opening, the second side opening, and the front opening are in fluid communication, wherein the hanging chair is configured to transition from a rest position to a load position in response to receiving a load within an interior of the hanging chair, wherein the hanging chair is in a different orientation in the rest position compared to in the load position, wherein in the rest position the bottom portion of the front frame is tilted axially forward the top portion of the front frame, and wherein in the load position the bottom portion of the front frame is axially closer to the top portion of the front compared to in the rest position.

14. The hanging chair system of claim 13, wherein the plurality of support members also comprise a first inner support member and a second inner support member, and wherein the first inner support member and the second inner support member are disposed between the first outer support member and the second outer support member.

15. The hanging chair system of claim 14, wherein the first outer support member couples to the top portion of the front frame at a first coupling point, the second outer support member couples to the top portion of the front frame at a second coupling point, the first inner support member couples to the top portion of the front frame at a third coupling point, and the second inner support member couples to the top portion of the front frame at a fourth coupling point, and wherein the first coupling point, the second coupling point, the third coupling point, and the fourth coupling point comprise different locations on the front frame.

16. The hanging chair system of claim 15, further comprising an anchor coupled to the top portion of the front frame, wherein the anchor is disposed between the third coupling point and the fourth coupling point, and wherein the anchor is configured to couple the hanging chair to the second end of the connecting structure.

17. The hanging chair system of claim 13, wherein the hanging chair further comprises:

a first armrest coupled to the front frame and the first outer support member, wherein the first armrest intersects the first side opening, and wherein the intersection of the first armrest in the first side opening defines a first side top opening of the first side opening above the first armrest and a first side bottom opening of the first side opening below the first armrest; and a second armrest coupled to the front frame and the second outer support member, wherein the second armrest intersects the second side opening, and wherein the intersection of the second armrest in the second side opening defines a second side top opening of the second side opening above the second armrest and a second side bottom opening of the second side opening below the second armrest.

18. A hanging chair comprising:

a front frame defining a front opening;

a first outer support member coupled to the front frame at a top portion of the front frame and at a bottom portion of the front frame, wherein the first outer support member extends from the top portion of the front frame to the bottom portion of the front frame, wherein the first outer support member extends axially rearward the front frame, and wherein the first outer support member and the front frame define a first side opening in fluid communication with the front opening;

a second outer support member coupled to the front frame at the top portion of the front frame and at the bottom portion of the front frame, wherein the second outer support member extends from the top portion of the front frame to the bottom portion of the front frame, wherein the second outer support member extends axially rearward the front frame, and wherein the second outer support member and the front frame define a second side opening in fluid communication with the front opening; and a first inner support member coupled to the front frame at the top portion of the front frame and at the bottom portion of the front frame, wherein the first inner support member is disposed between the first outer support member and the second outer support member, wherein the first inner support member extends from the top portion of the front frame to the bottom portion of the front frame, and wherein the first inner support member extends axially rearward the front frame.

19. The hanging chair of claim 18, wherein the first outer support member is coupled to the top portion of the front frame at a first top coupling point, the second outer support member is coupled to the top portion of the front frame at a second top coupling point, and the first inner support member is coupled to the top portion of the front frame at a third top coupling point, and wherein the first top coupling point, the second top coupling point, and the third top coupling point comprise different locations on the front frame.

20. The hanging chair of claim 18, wherein the first outer support member is coupled to the bottom portion of the front frame at a first bottom coupling point, the second outer support member is coupled to the bottom portion of the front frame at a second bottom coupling point, and the first inner support member is coupled to the bottom portion of the front frame at a third bottom coupling point, and wherein the first bottom coupling point, the second bottom coupling point, and the third bottom coupling point comprise different locations on the front frame.

* * * * *